US005768927A

United States Patent [19]

Kajiwara et al.

[11] Patent Number: 5,768,927

[45] **Date of Patent: *Jun. 23, 1998**

[54] ROLLING MILL, HOT ROLLING SYSTEM, ROLLING METHOD AND ROLLING MILL REVAMPING METHOD

[75] Inventors: Toshiyuki Kajiwara, Tokyo; Tokuji Sugiyama, Ibaraki-ken; Yoshio Takakura, Hitachi; Takao Sakanaka, Hitachi; Yasutsugu Yoshimura, Hitachi; Ken-ichi Yasuda, Katsuta; Shinichi Kaga, Hitachi, all of Japan

[73] Assignee: Hitachi Ltd., Tokyo, Japan

[ * ] Notice: The term of this patent shall not extend beyond the expiration date of Pat. No. 5,524,465.

[21] Appl. No.: 685,605

[22] Filed: Jul. 24, 1996

Related U.S. Application Data

[63] Continuation of Ser. No. 224,017, Apr. 6, 1994, abandoned, which is a continuation-in-part of Ser. No. 859,945, Mar. 30, 1992, abandoned.

[30] Foreign Application Priority Data

Mar. 29, 1991 [JP] Japan ..... 3-066007
Feb. 6, 1992 [JP] Japan ..... 4-020956

[51] Int. Cl.[6] ..... B21B 37/58

[52] U.S. Cl. ..... 72/10.1; 72/12.1; 72/13.4; 72/241.4; 72/201; 72/236

[58] Field of Search ..... 72/241.2, 241.4, 72/42, 43, 366.2, 201, 236, 7.5, 8.3, 8.8, 9.5, 10.1, 11.1, 11.5, 12.1, 12.5

[56] References Cited

U.S. PATENT DOCUMENTS 1,954,289 4/1934 Geeseman ..... 72/236
2,275,113 3/1942 Simborg ..... 72/236

(List continued on next page.)

FOREIGN PATENT DOCUMENTS 0184481 11/1986 France .
0027159 10/1972 Japan .
0017515 5/1977 Japan .
0045583 3/1980 Japan ..... 72/241.2
0137011 8/1982 Japan .
0199501 12/1982 Japan .
0157504 9/1983 Japan ..... 72/241.2
0013504 1/1984 Japan ..... 72/241.2
0039408 3/1984 Japan .
0040924 9/1985 Japan ..... 72/241.2
0279305 12/1986 Japan .
0134102 6/1987 Japan .
0263802 11/1987 Japan .
3-066007 3/1991 Japan .
5-50110 3/1993 Japan .

OTHER PUBLICATIONS

Five–Page European Search Report, Jul. 1992.

Neport, "Application of a working Lubricant on a Wide Hot Strip Rolling Mill", Iron and Steel, Apr. 1971, pp. 103–104.

(List continued on next page.)

*Primary Examiner*—Lowell A. Larson
*Assistant Examiner*—Ed Tolan
*Attorney, Agent, or Firm*—Evenson McKeown Edwards & Lenahan, PLLC

[57] ABSTRACT

A work roll crossing type rolling mill has back-up rolls arranged in such a manner that their axes are not inclined in a horizontal plane. Work rolls are constructed in such a manner that their axes can be inclined in a horizontal plane relative to the backup rolls such that the axes of the work rolls cross the axes of the back-up rolls and such that the axes of the work rolls cross each other. A lubricant supply device is provided for supplying a lubricant between each work roll and each back-up roll combination to greatly reduce the thrust exerted to the work rolls, whereby the rolling mill is given an excellent ability of controlling the crown of the material to be rolled.

49 Claims, 15 Drawing Sheets

U.S. PATENT DOCUMENTS

| | | | |
|---|---|---|---|
| 3,208,253 | 9/1965 | Roberts | 72/21 |
| 3,763,679 | 10/1973 | Lane et al. | 72/236 |
| 3,803,888 | 4/1974 | Hostetter et al. | 72/236 |
| 4,132,342 | 1/1979 | Nitto et al. | 72/365.2 |
| 4,315,421 | 2/1982 | Wilson | 72/236 |
| 4,385,512 | 5/1983 | Matsumoto et al. | 72/199 |
| 4,478,063 | 10/1984 | Duke | 72/236 |
| 4,727,741 | 3/1988 | Ushifusa et al. | 72/241.2 |
| 5,524,465 | 6/1996 | Kajiwara et al. | 72/241.2 |

OTHER PUBLICATIONS

Tsukamoto et al., "Shape and Crown Control Mill–Crossed Roll System," Iron and Steel Engineer, Oct. 1984, pp. 26–33.

Kapnin, Vladimir Victorovich, "Development of Main Technological Parameters of Strip Rolling Process in Crossed Rolls of Four–High Stand", Ministry of Higher and Secondary Education, Moskowsky Ordena Oktaybrskoy Revolutsii i Ordena Trudovogo Krasnogo Znameni Institut Staly i Splavov, pp. 16–21 and translation.

V.N. Khloponin, V.V. Kapnin, "Investigation Into The Methods For Adjustment of A Strip Lateral Section in A Four–High Mill Stand", *Proceedings of Higher Educational Institutions, Ferrous Metallurgy*, No. 7, 1986, pp. 82–85 and translation.

V.V. Kapnin, V.N. Khloponin, "On Determining Contact Pressure inRolling With Crossed Working Rolls", p. 149 and translation.

"Specialized Lubricants Used in Rolling Practice," A.P. Grudev and V.T. Tilik, pp. 280,282 (1975).

THRUST FORCE VARIATION AFTER SUSPENTION OF LUBRICATION

ROLLING MILL, HOT ROLLING SYSTEM, ROLLING METHOD AND ROLLING MILL REVAMPING METHOD

RELATED APPLICATION

This application is a continuation of application Ser. No. 08/224,017, now abandoned filed on Apr. 6, 1994, which is a continuation-in-part of application Ser. No. 07/859,945 now abandoned filed on Mar. 30, 1992.

BACKGROUND OF THE INVENTION

1. Field of the Invention

The present invention relates to a rolling mill and, more particularly, a work roll crossing type sheet rolling mill which exhibits an excellent ability with which it controls the crown of materials to be rolled, as well as a hot rolling system, a rolling method and a rolling mill revamping method.

2. Description of the Prior Art

In roll cross type four high rolling mills which are available on the market, a roll pair consisting of an upper work roll and an upper back-up roll and a roll pair consisting of a lower work roll and a lower back-up roll are moved such that the axes of the two roll pairs cross each other on a horizontal plane. Such roll cross type four high rolling mills have been described in, for example, Mitsubishi Heavy Industrial Co., Ltd. Technical Report, Vol. 21, No. 6 (1984) from p61 to p67.

Four high rolling mills in which crossing of only the work rolls is performed have been proposed earlier than the pair cross type rolling mills in, for example, Japanese Patent Unexamined Publication No. 47-27159. However, it is only the aforementioned pair cross type rolling mill used for hot-rolling that has been put into practical use.

In the so-called pair cross type rolling mill in which a pair of the work roll and the back-up roll cross another pair of the work roll and the back-up roll, although generation of slip or thrust between the back-up roll and the work roll is suppressed, since the center of a metal chock of the back-up roll which is directly subjected to a rolling load shifts from the center of a reduction screw, rotational moment is exerted to the metal chock, generating a local load to the mill stand. Consequently, smooth rolling operation is prohibited and wear of the metal chock is accelerated. To prevent these drawbacks, a very rigid beam may be provided to balance the drive side and the operated side of the rolling mill. However, provision of such a rigid beam increases the overall size of the rolling mill.

Whereas the thrust exerted to the work rolls which do not cross each other is generally 1 to 2% of the rolling loads in the case of the hot rolling, the thrust exerted to the work rolls which cross each other is 5% of the rolling load, which is twice or three times that of the work rolls which do not cross each other.

Adjustment of the cross angle during rolling is necessary, because it enables changes in the rolling load or the crown of the material to be rolled to be coped with during rolling or because it enables the incorrectly set cross angle to be corrected. These would not be achieved by the bender alone, and changes in the cross angle in a state wherein a large rolling load is being exerted are thus necessitated. In recent years, the rolling operation in the finish rolling mill stand of the hot strip mill has been directed to continuous operation. In the continuous rolling operation, the metal chock of the back-up roll must be moved during rolling, i.e., under enormous rolling loads, thus necessitating a special bearing. This makes the structure of the rolling mill more complicated. Also, a troublesome maintenance is necessary due to scales entering the lower portion of the rolling mill stand, and productivity is greatly reduced.

Thus, crossing of only the work rolls enables accurate changes in the cross angle to be readily performed during rolling without making the structure complicated. The force required for the crossing of the work rolls is very small and is about 1–2% of the rolling loads.

The rolling mill in which crossing of only the work rolls is performed cannot be put into practical use for the following two reasons.

First, when the work rolls cross the back-up rolls, an enormous amount of thrust is exerted to both the work rolls and the back-up rolls in two directions along the axis of the rolls, as described in "Research of Machines, Vol. 42, No. 10 (1990)" from page 71 to page 72. This thrust, which changes depending on the cross angle, is about 30% of the rolling loads. The thrust bearing of the large diameter back-up roll may sustain this thrust. However, it is very difficult for the work roll whose diameter is one half or less than that of the back-up roll to do that.

The second reason is roll wear caused by relative slip between the back-up roll and the work roll. Since the work rolls are changed with new ones every 2 or 3 hours due to wear caused by the material to be rolled which is greater than wear caused by relative slip, changing of the work rolls causes no problem. However, changing of the back-up roll takes place every 10 or 20 days and requires a long time. Therefore, frequent changing of the back-up rolls due to rapid wear greatly reduces productivity.

SUMMARY OF THE INVENTION

A primary object of the present invention is to provide a work roll crossing type rolling mill which has an excellent capability with which it controls crown of materials to be rolled, and which achieves reduction in the thrust exerted to the work rolls by a simple structure.

A second object of the present invention is to provide a work roll crossing type rolling mill, which has an excellent capability with which it controls crown of materials to be rolled, which achieves reduction in the thrust exerted to the work rolls by a simple structure, and which allows for schedule free rolling.

A third object of the present invention is to provide a work roll crossing type rolling mill, which has an excellent capability with which it controls crown of materials to be rolled, which achieves reduction in the thrust exerted to the work rolls by a simple structure, and which enables generation of an excessive thrust between the work roll and the back-up roll to be prevented.

A fourth object of the present invention is to provide a work roll crossing type rolling mill, which has an excellent capability with which it controls crown of materials to be rolled, which achieves reduction in the thrust exerted to the work rolls by a simple structure, which allows for schedule free rolling, and which enables generation of an excessive thrust between the work roll and the back-up roll to be prevented.

A fifth object of the present invention is to provide a hot rolling system including a work roll crossing type rolling mill which has an excellent capability with which it controls the crown of materials to be rolled, which achieves reduction in the thrust exerted to the work rolls by a simple structure, and which allows for schedule free rolling.

A sixth object of the present invention is to provide a rolling method for a work roll crossing type rolling mill which has an excellent capability with which it controls the crown of materials to be rolled, and which achieves reduction in the thrust exerted to the work rolls by a simple structure.

A seventh object of the present invention is to provide a rolling method for a work roll crossing type rolling mill which has an excellent capability with which it controls crown of materials to be rolled, which achieves reduction in the thrust exerted to the work rolls by a simple structure, and which allows for schedule free rolling.

An eighth object of the present invention is to provide a rolling method for a work roll crossing type rolling mill which has an excellent capability with which it controls crown of materials to be rolled, which achieves reduction in the thrust exerted to the work rolls by a simple structure, and which enables changes in the crown to be performed during rolling.

A ninth object of the present invention is to provide a rolling method for a work roll crossing type rolling mill which has an excellent capability with which it controls crown of materials to be rolled, which achieves reduction in the thrust exerted to the work rolls by a simple structure, which allows for schedule free rolling, and which enables changes in the crown to be performed during rolling.

A tenth object of the present invention is to provide a revamping method of a work roll crossing type rolling mill which has an excellent capability with which it controls crown of materials to be rolled, and which achieves reduction in the thrust exerted to the work rolls by a simple structure.

The two problems which have prohibited the aforementioned work roll crossing type rolling mill from being put into practical use, that is excessive thrust generated between the rolls and wear of the back-up rolls, can be overcome by lubrication between the rolls according to the present invention. It is inferred that lubrication between the rolls has not been practiced for the following reasons.

The work roll crossing type mills have an excellent crown control capability and are thus suitable for use as the hot rolling mill. However, in the work roll crossing type mill used as the hot rolling mill, a lubricant has not been used because a large amount of high-pressure water (coolant) supplied to cool the surface of the roll may wash away a lubricant, reducing the lubricating effect to zero (or to a very small level), or because the lubricant which reaches the material being rolled located between the work rolls (a roll bite portion) may prohibit bite of a subsequent material to be rolled.

However, recently, a hot rolling lubricant which can maintain the lubricating property at high temperatures is supplied to a roll bite portion not to provide lubrication between the rolls but to reduce a rolling load and rolling power only when a material to be hot rolled is present in the roll bite. Supply of the lubricant is suspended before the trailing end of the material being rolled leaves the rolling mill, and the lubricant remaining or the surface of the work roll is burned by the high-temperature material being rolled, by which prohibition of bite of a subsequent material to be rolled is eliminated.

In the work roll crossing mill according to the present invention, since the work rolls are in contact with the reinforcing rolls in a crossed state, lubrication between the rolls must be always performed during rolling to prevent excessive thrust between the rolls. Hence, the present invention would not be accomplished based on the conventional knowledge or concept.

The present inventors made intensive studies and discovered that it is possible to always reduce the thrust coefficient between the work roll and the back-up roll without deteriorating the biting property of the material to be rolled.

That is, a work roll crossing mill according to the present invention has been accomplished for the following reasons:

1) The use of a certain type of lubricant does not deteriorate the biting property of the material to be rolled even when lubrication between the rolls is continued.
2) Although the lubricant remaining on the work roll after supply of the lubricant is suspended is burned by the material being rolled, the lubricant attached to the surface of the reinforcing roll is firmly fixed to the surface of the roll and therefore remains there even when the roll surface is washed by a large amount of coolant. Thus, generation of an excessive thrust between the rolls can be prevented.

The first object of the present invention is achieved by the provision of a rolling mill in which the back-up rolls are constructed in such a manner that axes thereof are not inclined in a horizontal plane while the work rolls are constructed in such a manner that axes thereof can be inclined in a horizontal plane relative to the back-up rolls such that the axes of the work rolls cross the axes of the back-up rolls and such that the axes of the work rolls cross each other, and in which a lubricant supply device for supplying a lubricant between each work roll and each back-up roll is provided.

The second object of the present invention can be achieved by the provision of a rolling mill in which the back-up rolls are constructed in such a manner that axes thereof are not inclined in a horizontal plane while the work rolls are constructed in such a manner that axes thereof can be inclined in a horizontal plane relative to the back-up rolls such that the axes of the work rolls cross the axes of the back-up rolls and such that the axes of the work rolls cross each other, in which the work rolls are movable in the axial direction thereof, and in which a lubricant supply device for supplying a lubricant between each work roll and each back-up roll is provided.

The third object of the present invention can be achieved by the provision of a rolling mill in which the back-up rolls are constructed in such a manner that axes thereof are not inclined in a horizontal plane while the work rolls are constructed in such a manner that axes thereof can be inclined in a horizontal plane relative to the back-up rolls such that the axes of the work rolls cross the axes of the back-up rolls and such that the axes of the work rolls cross each other, in which a lubricant supply device for supplying a lubricant between each work roll and each back-up roll is provided, and in which a member for preventing a cooling water for each work roll from entering the back-up roll is provided in the vicinity of the work roll.

The fourth object of the present invention can be achieved by the provision of a rolling mill in which the back-up rolls are constructed in such a manner that axes thereof are not inclined in a horizontal plane while the work rolls are constructed in such a manner that axes thereof can be inclined in a horizontal plane relative to the back-up rolls such that the axes of the work rolls cross the axes of the back-up rolls and such that the axes of the work rolls cross each other, in which the work rolls are movable in the axial direction thereof, in which a lubricant supply device for supplying a lubricant between each work roll and each back-up roll is provided, and in which a member for preventing a cooling water for the work roll from entering the back-up roll is provided in the vicinity of the work roll.

The fifth object of the present invention can be achieved by the provision of a hot rolling system in which a joining device for joining materials being rolled is provided between a roughing mill and a finish mill, and in which the materials which have been rolled by the roughing mill are rolled continuously by the finish rolling mill. The finish rolling mill comprises a rolling mill which includes a pair of work rolls and a pair of back-up rolls for respectively supporting the work rolls. The back-up rolls are constructed in such a manner that axes thereof are not inclined in a horizontal plane while the work rolls are constructed in such a manner that axes thereof can be inclined in a horizontal plane relative to the back-up rolls such that the axes of the work rolls cross the axes of the back-up rolls and such that the axes of the work rolls cross each other. The work rolls are movable in the axial direction thereof. A lubricant supply device for supplying a lubricant between the work roll and the back-up roll is provided.

The sixth object of the present invention is achieved by the provision of a rolling method which comprises the step of adjusting a crown of the materials being rolled by controlling, during rolling, an inclination of axes of the work rolls relative to the back-up rolls in a horizontal plane in such a manner that the axes of the work rolls cross the axes of the back-up rolls and that the axes of the work rolls cross each other in a state wherein a lubricant is supplied between the work roll and the back-up roll.

The seventh object of the present invention is achieved by the provision of a rolling method which comprises the step of adjusting a crown of the materials being rolled by controlling, during rolling, an inclination of axes of the work rolls relative to the back-up rolls in a horizontal plane in such a manner that the axes of the work rolls cross the axes of the back-up rolls and that the axes of the work rolls cross each other and by controlling a movement of the work roll in the axial direction thereof in a state wherein a lubricant is supplied between the work roll and the back-up roll.

The eighth object of the present invention is achieved by the provision of a rolling method which comprises the step of adjusting a crown of the materials being rolled by controlling, during rolling, an inclination of axes of the work rolls relative to the back-up rolls in a horizontal plane in such a manner that the axes of the work rolls cross the axes of the back-up rolls and that the axes of the work rolls cross each other and by changing a cross angle of the work rolls during rolling in a state wherein a lubricant is supplied between the work roll and the back-up roll.

The ninth object of the present invention is achieved by the provision of a rolling method which comprises the step of adjusting a cross of the material being rolled by controlling, during rolling, an inclination of axes of the work rolls relative to the back-up rolls in a horizontal plane in such a manner that the axes of the work rolls cross the axes of the back-up rolls and that the axes of the work rolls cross each other, by controlling a movement of the work roll in the axial direction thereof and by changing a cross angle of the work rolls during rolling in a state wherein a lubricant is supplied between the work roll and the back-up roll.

The tenth object of the present invention can be achieved by the provision of a method of revamping a rolling mill which comprises the steps of: providing hydraulic devices on a position on the rolling stand which opposes a roll chock of the work roll in such a manner that they can be operated in a direction in which a material being rolled processes, so that they can incline the work rolls relative to the back-up rolls in a horizontal plane such that the axes of the work rolls cross axes of the back-up rolls and such that the axes of the work rolls cross each other; providing a hydraulic device on the rolling stand in such a manner that it can be operated in an axial direction of the work roll, so that it can engage with the roll chock of the work roll to thereby move the work roll in the axial direction thereof; and providing a lubricant supply device for supplying a lubricant between the work roll and the back-up roll.

In the first aspect of the present invention, the back-up rolls are constructed such that axes thereof are not inclined in a horizontal plane while the work rolls are constructed such that axes thereof can be inclined relative to the back-up rolls in a horizontal plane in such a manner that the axes of the work rolls cross the axes of the back-up rolls and such that the axes of the work rolls cross each other. It is therefore possible to provide a rolling mill in which crossing of only the work rolls is performed.

Furthermore, since the lubricant supply device for supplying a lubricant between the work roll and the back-up roll is provided, the thrust exerted to the work roll can be reduced to a degree at which it causes no problem in a practical operation even when the work rolls cross each other by the action of the lubricant supplied between the work roll and the back-up roll. It is therefore possible to provide a work roll crossing type rolling mill which shows an excellent ability with which it controls crown of the materials to be rolled.

In the second aspect of the present invention, the back-up rolls are constructed such that axes thereof are not inclined in a horizontal plane while the work rolls are constructed such that axes thereof can be inclined relative to the back-up rolls in a horizontal plane in such a manner that the axes of the work rolls cross the axes of the back-up rolls and such that the axes of the work rolls cross each other. It is therefore possible to provide a rolling mill in which crossing of only the work rolls is performed.

Furthermore, since the work rolls are movable in the axial direction thereof, they can be moved in the axial direction thereof during rolling. Consequently, schedule free rolling is allowed.

Furthermore, since the lubricant supply device for supplying a lubricant between the work roll and the back-up roll is provided, the thrust exerted to the work roll can be reduced to a degree at which it causes no problem in a practical operation even when the work rolls cross each other by the action of the lubricant supplied between the work roll and the back-up roll. It is therefore possible to provide a work roll crossing type rolling mill which shows an excellent ability with which it controls crown of the materials to be rolled.

In the third and fourth aspects of the present invention, a member for preventing cooling water for the work roll from entering between rolls is provided in the vicinity of the work roll in addition to the structure mentioned in the first and second aspects of the present invention. Consequently, the lubricant supplied between the work roll and the back-up roll is not washed away by the cooling water, and generation of an excessive thrust between the work roll and the back-up roll can thus be prevented.

In the fifth aspect of the present invention, a finish rolling mill, used in a hot rolling system in which a joining device for joining materials being rolled with each other is provided between a rough rolling mill and the finish rolling mill and in which the materials which have been rolled by the rough rolling mill are continuously rolled by the finish rolling mill, comprises a rolling mill which includes a pair of work rolls and a pair of reinforcing rolls for respectively supporting the work rolls. The back-up rolls are constructed such that axes thereof are not inclined in a horizontal plane while the work rolls are constructed such that axes thereof can be inclined relative to the back-up rolls in a horizontal plane in such a manner that the axes of the work rolls cross the axes of the back-up rolls and such that the axes of the work rolls cross each other. It is therefore possible to provide a rolling mill in which crossing of only the work rolls is obtained.

Furthermore, since the work rolls are movable in the axial direction thereof, they can be moved in the axial direction thereof during rolling. Consequently, schedule free rolling is allowed.

Furthermore, since the lubricant supply device for supplying a lubricant between the work roll and the back-up roll is provided, the thrust exerted to the work roll can be reduced to a degree at which it causes no problem in a practical operation even when the work rolls cross each other by the action of the lubricant supplied between the work roll and the back-up roll. It is therefore possible to provide a work roll crossing type rolling mill which shows an excellent ability with which it controls crown of the materials to be rolled.

It is therefore possible to use the work roll crossing type rolling mill as the finish rolling mill of the hot rolling system in which the materials rolled by the rough rolling mill are continuously rolled.

In the sixth aspect of the present invention, an inclination of axes of only the work rolls relative to the back-up rolls on a horizontal plane is controlled, during rolling, such that the axes of the work rolls cross the axes of the back-up rolls and such that the axes of the work rolls cross each other in a state wherein a lubricant is supplied between the work roll and the back-up roll. Consequently, the thrust exerted to the work roll can be reduced to a degree at which it causes no problem in a practical operation even when the work rolls cross each other by the action of the lubricant supplied between the work roll and the back-up roll.

Consequently, the cross of the material to be rolled can be controlled excellently using a rolling mill in which crossing of only the work rolls is performed. It is therefore possible to provide a rolling method for a work roll crossing type rolling mill.

In the seventh aspect of the present invention, since the amount of movement of the work roll in the axial direction is controlled in addition to the control operation performed in the sixth aspect of the present invention, changes in the width of the materials to be rolled can be coped with, and schedule free rolling is thereby made possible. It is therefore possible to provide a rolling method for a work roll crossing type rolling mill.

In the eighth aspect of the present invention, since the cross angle of the work roll can be changed during rolling in addition to the control operation performed in the sixth aspect of the present invention, the crown of the material to be rolled can be changed during rolling. It is therefore possible to provide a rolling method for a work roll crossing type rolling mill.

In the ninth aspect of the present invention, since the cross angle of the work roll can be changed during rolling in addition to the control operation performed in the seventh aspect of the present invention, the crown of the material to be rolled can be changed during rolling. It is therefore possible to provide a rolling method for a work roll crossing type rolling mill.

In the tenth aspect of the present invention, hydraulic devices are provided on a position on the rolling stand which opposes a roll chock of the work roll in such a manner that they can be operated in a direction in which a material being rolled proceeds, so that they can incline axes of the work rolls relative to the back-up rolls on a horizontal plane such that the axes of the work rolls cross axes of the back-up rolls and such that the axes of the work rolls cross each other. A hydraulic device is provided on the rolling stand in such a manner that it can be operated in an axial direction of the work roll, so that it can engage with the roll chock of the work roll and thereby move the work roll in the axial direction thereof. A lubricant supply device for supplying a lubricant between the work roll and the back-up roll is provided. It is therefore possible to provide a rolling mill in which crossing of only the work rolls is realized utilizing an existing rolling mill stand. Furthermore, since the work rolls can be moved in the axial direction during rolling, schedule free rolling is allowed. Furthermore, the thrust exerted to the work roll can be reduced to a degree at which it causes no problem in a practical operation even when the work rolls cross each other by the action of the lubricant supplied between the work roll and the back-up roll. Therefore, revamping of a rolling mill, which shows an excellent ability with which it controls cross of the materials to be rolled and in which the work rolls cross each other, is made possible.

The above and other objects, features and advantages of the present invention will be made more apparent by the following description with reference to the accompanying drawings.

DESCRIPTION OF PREFERRED EMBODIMENTS

Figure 1:
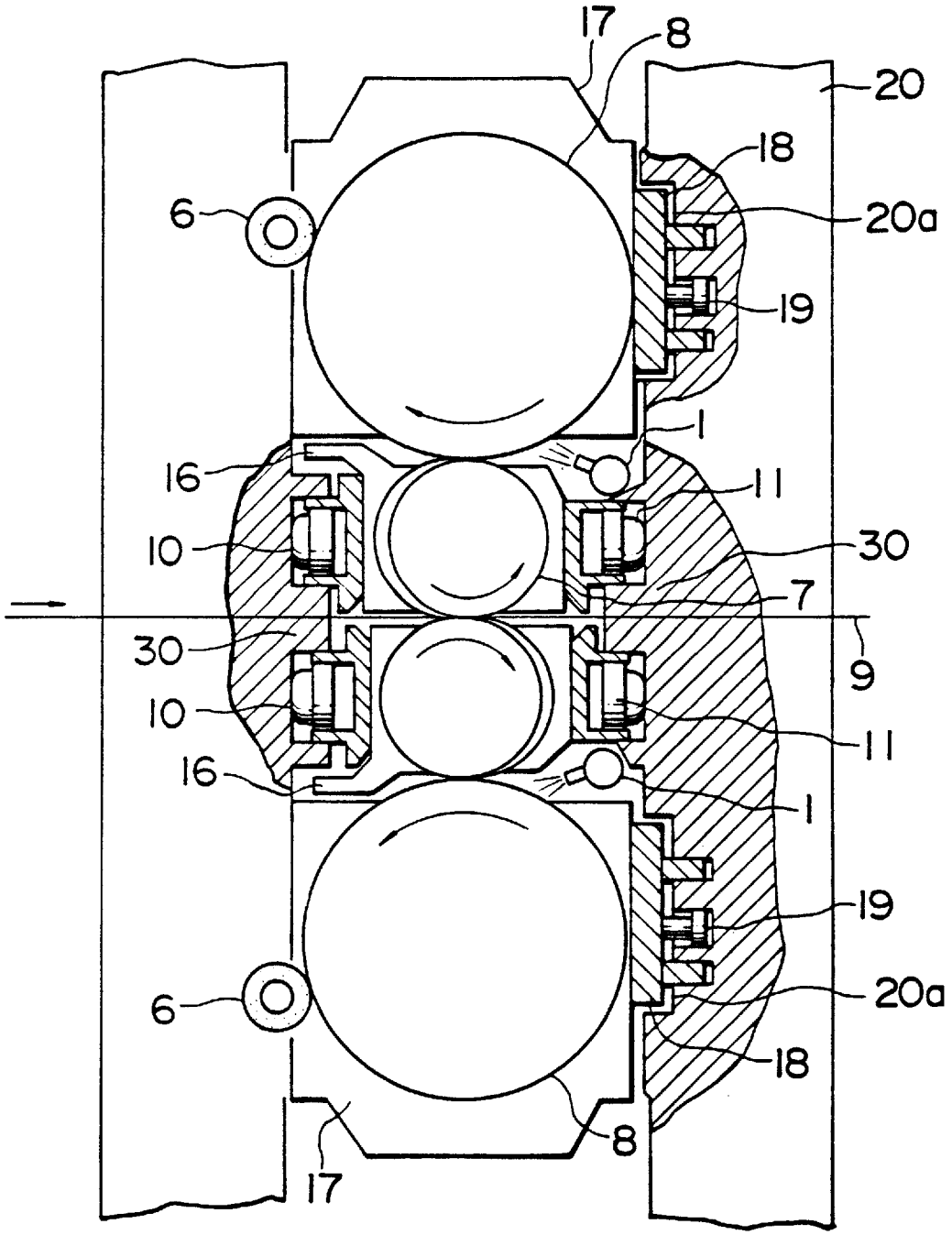
FIG. 1 is a schematic view of an embodiment of a work roll cross type four high rolling mill according to the present invention as seen in the direction of an axis of a roll.
Figure 2:
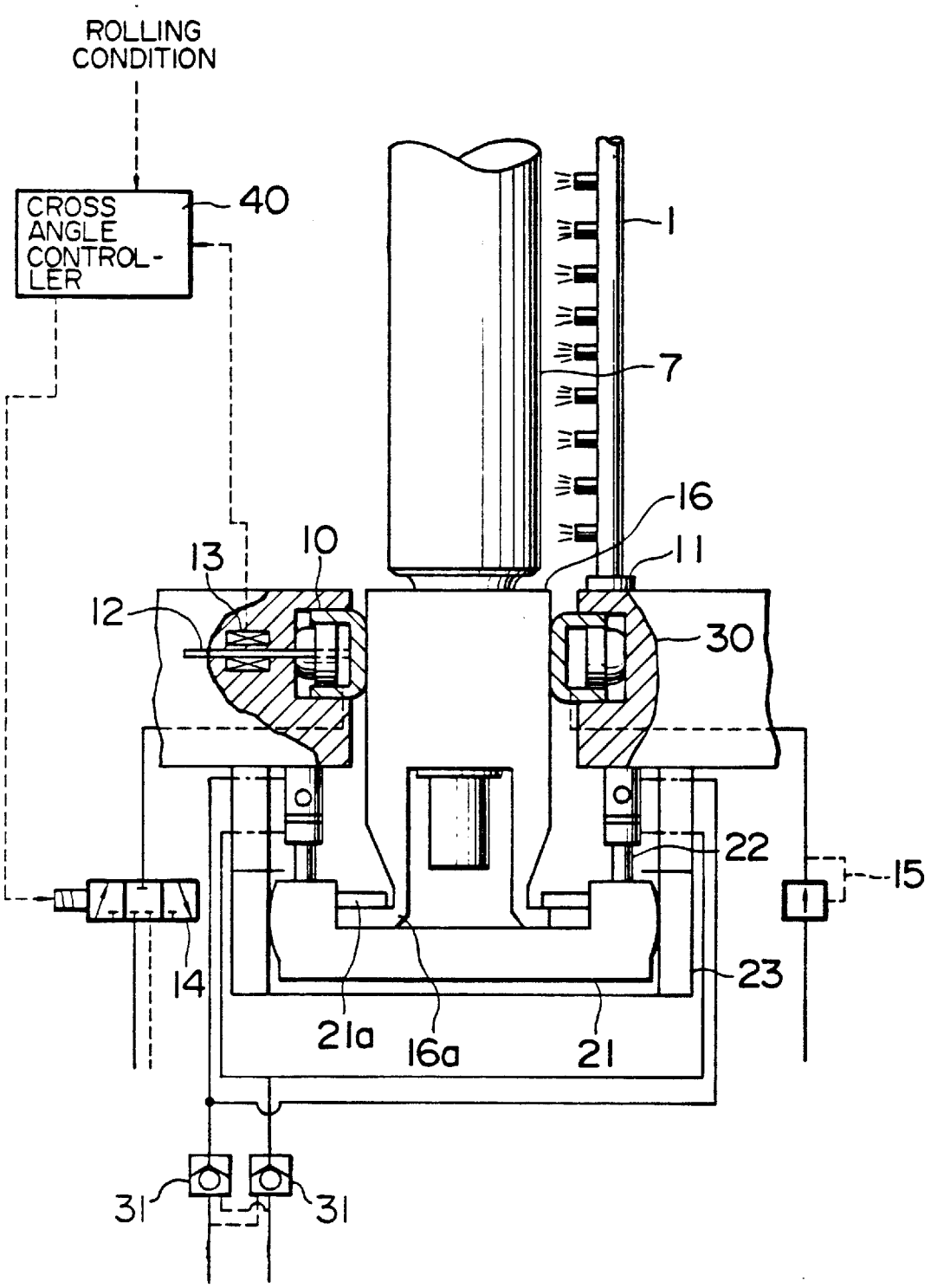
FIG. 2 illustrates a device for moving a work roll in the axial direction thereof in the work roll crossing type four high rolling mill shown in FIG. 1.

Referring to FIGS. 1 and 2, a cross type four high rolling mill includes upper and lower work rolls 7 and upper and lower back-up rolls 8 which support the work rolls. Work roll chocks 16 are provided at the roll ends of each of the work rolls 7 so as to rotatably support the work roll 7. Similarly, back-up roll chocks 17 are provided at the roll ends of each of the back-up rolls 8 to rotatably support the back-up roll 8.

The work roll chocks 16 and the back-up rolls chocks 17 are disposed such that they oppose window surfaces 20*a* of a pair of stands 20 provided erect in spaced relation in the roll axial direction of the rolling mill. Rolling loads are exerted to the individual rolls by means of jacks (not shown) provided in an upper or lower portion of the stands 20 to roll a material to be rolled 9.

To make the axes of the upper and lower work rolls 7 inclined relative to the axes of the back-up rolls 8 on a horizontal plane and to make the axes of the upper and lower work rolls 7 cross each other, hydraulic jacks 10 and 11 are provided on projecting blocks 30 of the stands 20 which oppose the two side surfaces of each of the work roll chocks 16 provided at the two ends of each of the upper and lower work rolls 7. The upper and lower work rolls 7 can be made to cross each other by operating both of the hydraulic jacks 10 and 11. Namely, the hydraulic jacks 10 and 11 have pistons and cylinders. The pistons of the jacks have piston heads disposed in engagement with the project blocks 30, while the cylinders of the jacks are engaged with the upper and lower work roll chocks 16. Accordingly, the hydraulic jacks 10 and 11 can be operated to move the cylinders of the jacks so that the upper and lower work roll chocks 16 are relatively moved to cross the upper and lower work rolls 7. Hydraulic oil is supplied to the hydraulic jack 10 through a switch-over valve 14. To detect the movement of a ram of the hydraulic jack 10, a sensor 13 detects a displacement of a rod 12 mounted on the ram. The hydraulic jack 10 is driven by a work roll cross angle controller 40 which adjusts the switch-over valve 14 on the basis of a signal corresponding to the rolling conditions. The work roll cross angle controller 40 also performs feedback control of the hydraulic jack 10 using the signal from the sensor 13 to obtain a desired cross angle of the upper and lower work rolls 7.

The cross angle can be changed during rolling, i.e., under enormous rolling loads.

Figure 3:
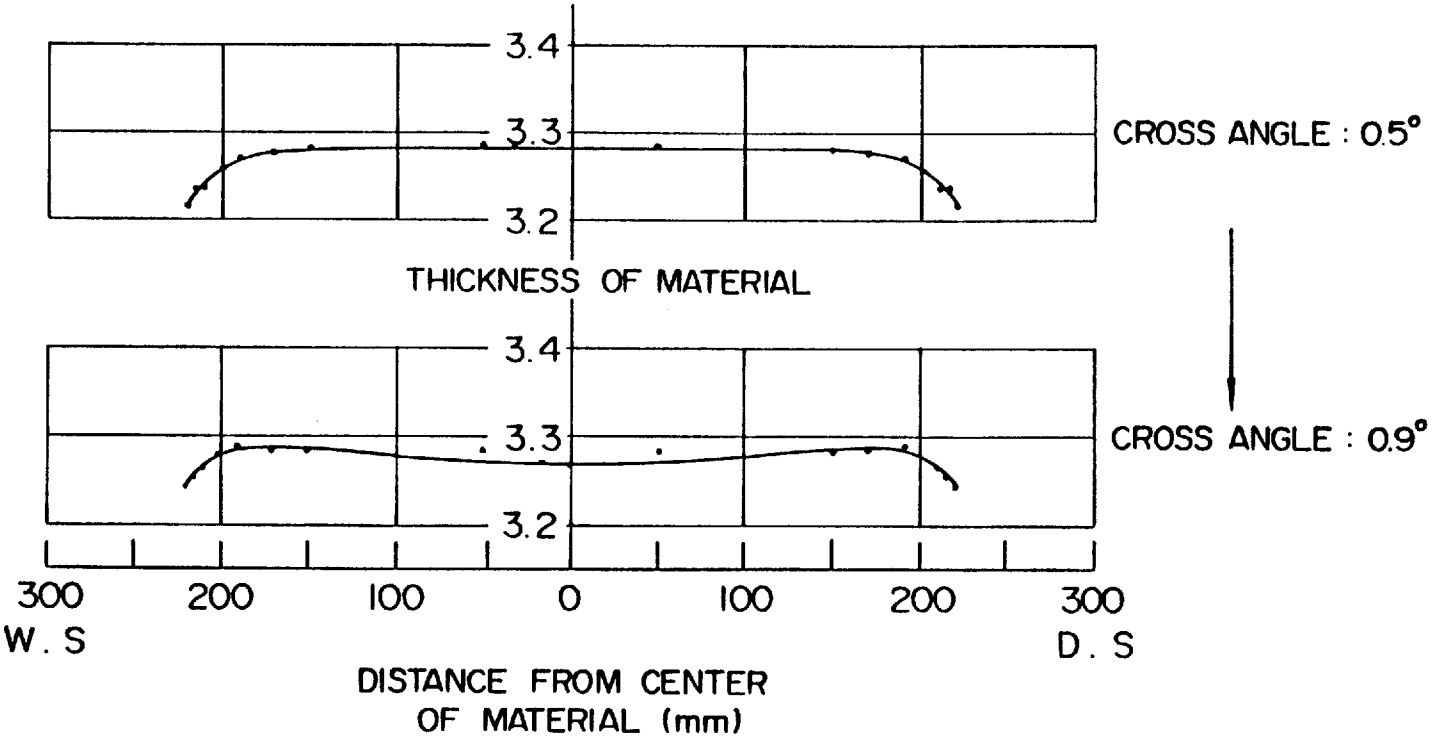
FIG. 3 is a graph showing the results of the experiments conducted to examine how the crown changes as a result of changes in the cross angle during rolling.

FIG. 3 illustrates the results of the experiments conducted to examine how the crown of the material being rolled changes by a change in the cross angle during rolling. It can be seen that a change in the cross angle from 0.5 degree to 0.9 degree can change a flat material to one having a concaved crown.

Hydraulic oil is supplied to the hydraulic jack 11 through a pressure reduction valve 15 so that the hydraulic jack 11 can press against the work roll chock 16 with a required force.

Two hydraulic cylinders 22 for driving the work roll along the axis thereof are provided on the stand 20 on the two sides of each of the work roll chocks 16 to move the work roll 7 in the axial direction thereof. Hydraulic oil is sealed in the hydraulic cylinders 22 by means of a pilot check valve 31 so as to allow the position of the hydraulic cylinders 22 to be maintained. The rods of the hydraulic cylinders 22 are coupled to a common movable clock 21. Locking portions 21*a* provided detachably on the common movable block 21 engage with projecting portions 16*a* formed at the end portion of the work roll chock 16, by which the driving force of the hydraulic cylinders 22 are transmitted to the work roll chock 16 and the work roll 7 can thereby be moved in the axial direction thereof.

Although not shown, the operation of moving the work roll 7 in the axial direction is controlled according to the rolling conditions by a movement control device.

As shown in FIGS. 1 and 2, lubricant supply nozzles 1 are respectively disposed along the roll axes to supply a lubricant between the upper work roll 7 and the upper back-up roll 8 and between the lower work roll 7 and the lower back-up roll 8. The position of the lubricant supply nozzle 1 is not limited to that illustrated in FIGS. 1 and 2 but the nozzle 1 can be located at any position where it can supply a lubricant, which is a lubricating agent, to between the two rolls. As will be seen in FIG. 2, the nozzle 1 has a plurality of nozzle orifices disposed in a row extending in the axial direction of the rolls 7 and 8 so that these rolls can be uniformly supplied with the lubricant.

Since a large amount of coolant is supplied to the work roll 7 from a nozzle 2, provision of a scraper 32 for preventing washing away of the lubricant is desired.

To prevent generation of backlash in the upper and lower back-up rolls 8 during rolling, hydraulic jacks 19 are provided on the window surfaces 20*a* of the stands 20 which opposes the side surface of the back-up roll chocks 17 provided at each of the roll ends of each of the upper and lower back-up rolls 8. A pressing plate 18 for transmitting the driving force of the hydraulic jack 19 is slidably mounted on the stand 20. The hydraulic pressure of the hydraulic jack 19 is exerted to the back-up roll chock 17 through the pressing plate 18 so as to eliminate backlash of the upper or lower back-up roll 8.

Figure 4:
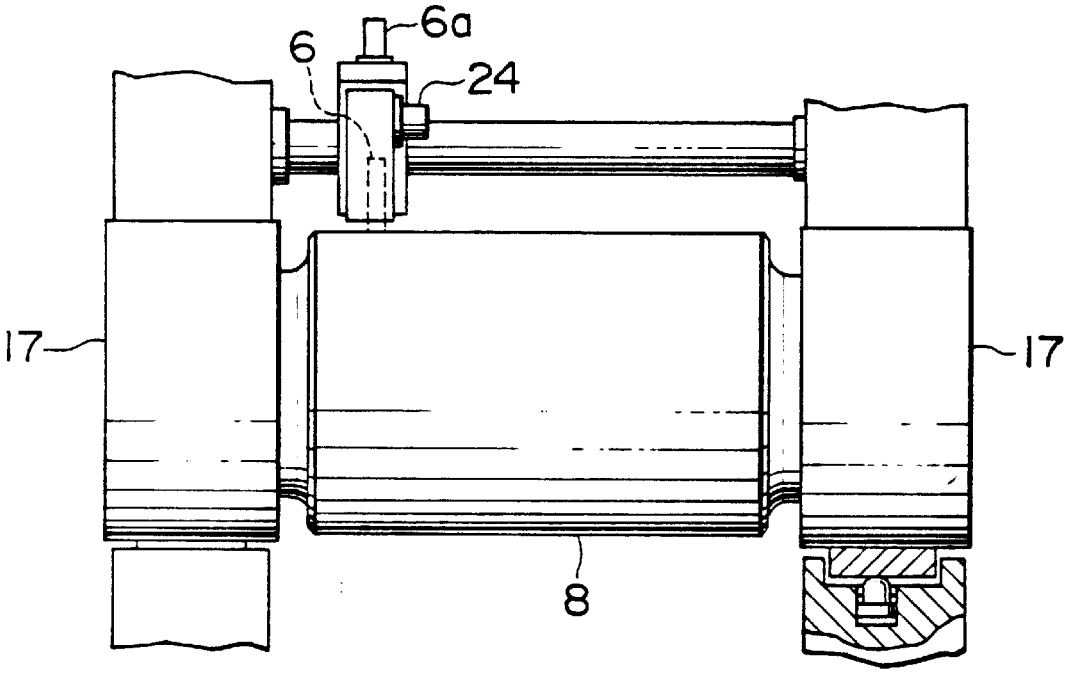
FIG. 4 illustrates a roll grinder for the back-up roll incorporated in the work roll crossing type four high rolling mill shown in FIG. 1.

A roll grinder 6 is provided near the roll surface of each of the upper and lower back-up rolls 8 so as to grind the roll surface during rolling. The roll grinder 6 is moved in the axial direction of the back-up roll 8 by means of a driving motor 24, as shown in FIG. 4. The degree at which the roll is ground is adjusted by means of a grinding quantity operator 6*a*.

Figure 5:
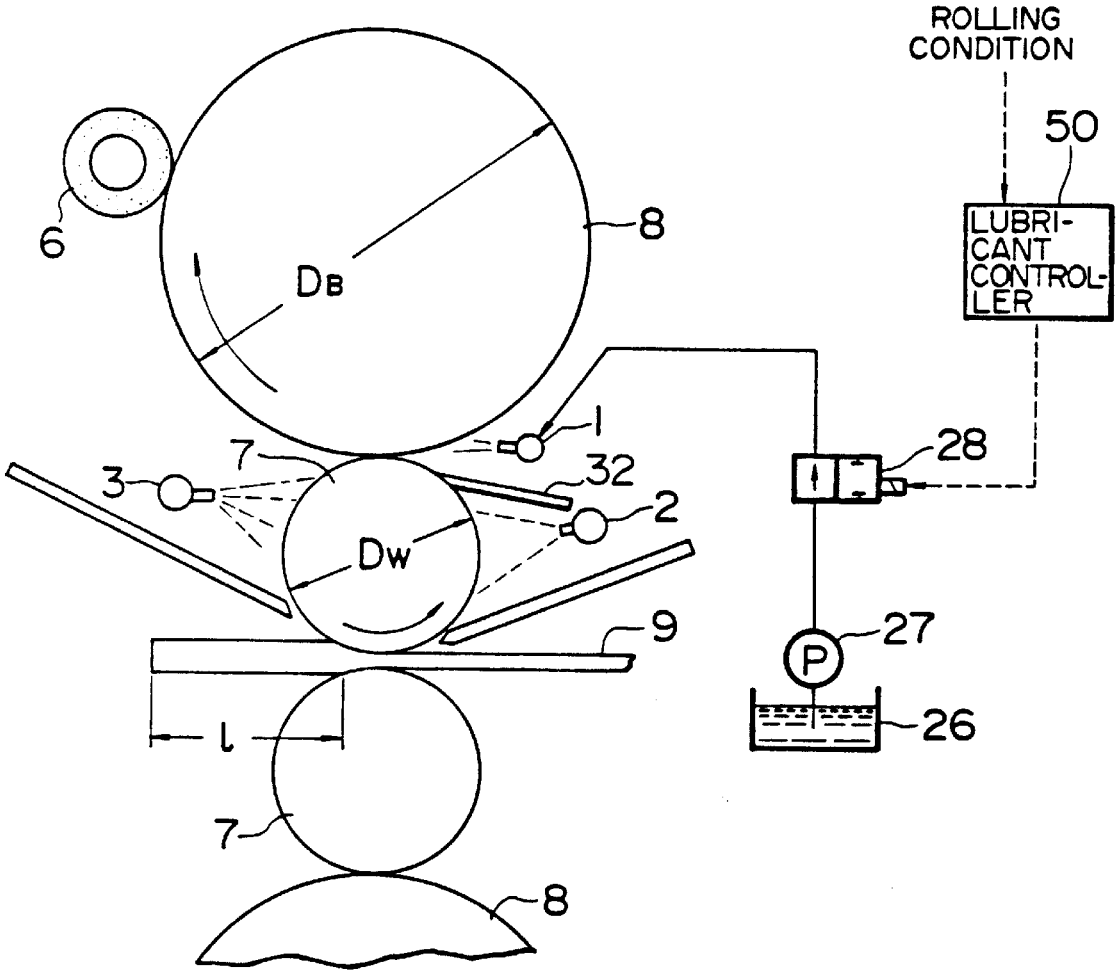
FIG. 5 illustrates how a roll lubricant and a coolant are supplied in the work roll crossing type four high rolling mill shown in FIG. 1.

As shown in FIG. 5, in the work roll cross type four high rolling mill, the lubricant reserved in a tank 26 is supplied from the lubricant supply nozzle 1 in a spray to between the work roll 7 and the back-up roll 8 by means of a pump 27 through a change-over valve 28. When the material being rolled 9 is present between the rolls and about to leave the roll, spraying of the lubricant must be suspended. Hence, when a lubricant controller 50 receives a signal representing the rolling conditions, such as ending or beginning of supply of the material to be rolled, it changes over the change-over valve 28 and thereby suspends spraying of the lubricant onto the roll surface from the lubricant supply nozzle 1.

Roll cooling nozzles 2 and 3 are used to cool the work roll and the back-up roll.

In the aforementioned work roll cross type four high rolling mill, whereas the back-up rolls 8 are not moved in the horizontal direction, the work rolls 7 are moved in opposite directions and are thereby made to cross each other. This cross type mill is suitable for use in a hot strip mill in which a large crown must be set in the material to be rolled 9, particularly, it is suitable for use as the front stand of the finish mill. In the hot rolling, a cooling water is mainly ejected to the upper and lower work rolls 7 from the roll cooling nozzles 2 and 3 due to the biting property of the materials to be rolled 9. In the crossing type work roll rolling, the utmost requirement is concerned with how the thrust exerted to the work rolls can be coped with.

Figure 6:
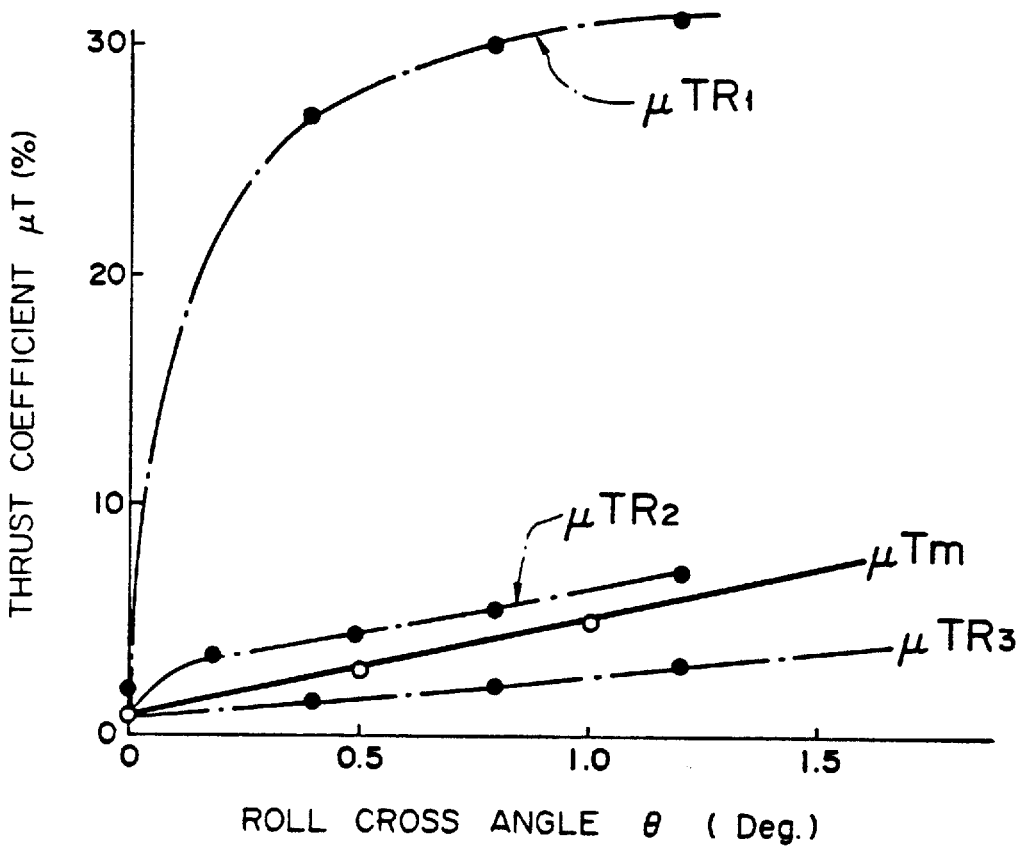
FIG. 6 is a graph showing the relation between the cross angle of the work roll in the work roll crossing type four high rolling mill, the thrust coefficient between the work roll and the back-up roll, and the thrust coefficient between the work roll and the material being rolled.

FIG. 6 are graphs respectively showing the cross angle of the work rolls in the work roll crossing type four high rolling mill, the thrust coefficient between the work roll and the back-up roll, and the thrust coefficient between the work roll and the material being rolled. In FIG. 6, the abscissa axis represents the cross angle of a single work roll relative to a line perpendicular to the direction of rolling. The ordinate axis represents the thrust coefficient. $\mu_{Tm}$ is a percentage obtained by dividing a thrust exerted to a single work roll 7 from the material being rolled 9 by the rolling load. $\mu_{Tm}$ is a function of the cross angle θ and other conditions, such as the draft. In general, the larger the draft, the lesser $\mu_{Tm}$. In the case of the pair cross rolling, since the cross angle between the work rolls and the back-up rolls does not exist, no thrust is theoretically generated, and the thrust exerted to the single work roll is obtained by multiplying $\mu_{Tm}$ by the rolling load. In the case in which crossing of only the upper and lower work rolls 7 is performed, the thrust generated between the back-up roll 8 and the work roll 7 differs depending on the rolling conditions. In FIG. 6, three examples of such thrusts are given as $\mu_{Tr1}$, $\mu_{Tr2}$ and $\mu_{TR3}$. $\mu_{TR1}$ indicates the results of experiments in which only water was supplied between the back-up roll 8 and the work roll 7. $\mu_{TR2}$ indicates the results of experiments in which the concentration of the lubricating oil present in the water supplied to the two rolls was low. $\mu_{TR3}$ indicates the results of experiments in which the concentration of the lubricating oil in the water was higher than that in $\mu_{TR2}$. As can be seen from FIG. 6, the thrust $\mu_{TR}$ can be greatly reduced by the supply of the lubricating oil between the rolls. The thrust $\mu_{TR}$ can be selected by selecting the concentration of the lubricating oil. In the aforementioned experiments, the concentration was changed. However, the amount of emulsion of lubricating oil and water may be changed to change the thrust.

Figure 7:
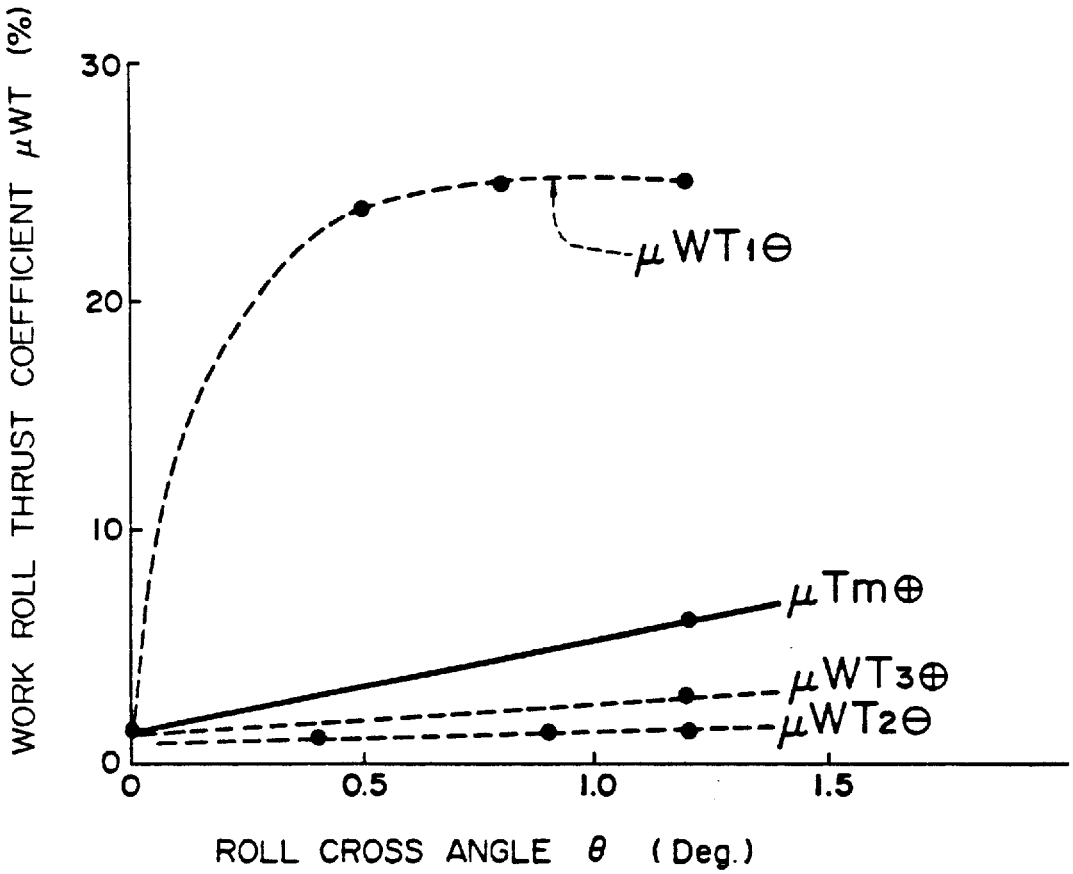
FIG. 7 is a graph obtained under a circumstance in which a roll lubricant is supplied between the rolls and showing the relation between the cross angle of the work roll in the work roll crossing type four high mill of the present invention, the thrust coefficient between the work roll and the back-up roll, and the thrust coefficient between the work roll and the material being rolled.

FIG. 7 shows the thrust coefficient $\mu_{WT}$ exerted to the work roll 7 when the axes of the work rolls are made to cross the material being rolled 9 and back-up rolls 8 while the back-up rolls 8 are fixed in the horizontal direction, i.e., the value obtained by dividing the thrust by the rolling load. The thrust coefficient $\mu_{WT}$ is a percentage representing the sum of the thrust exerted from the back-up roll and that exerted from the material being rolled.

In the conventional pair cross type rolling mill, $\mu_{WT}$ is the same as $\mu_{Tm}$ shown in FIG. 6. It is to be noted that the direction of the thrust exerted to the work roll 7 from the material being rolled 9 and that of the thrust exerted from the back-up roll 8 oppose each other.

This will be discussed in detail with reference to FIGS. 8 and 9.

Figure 8:
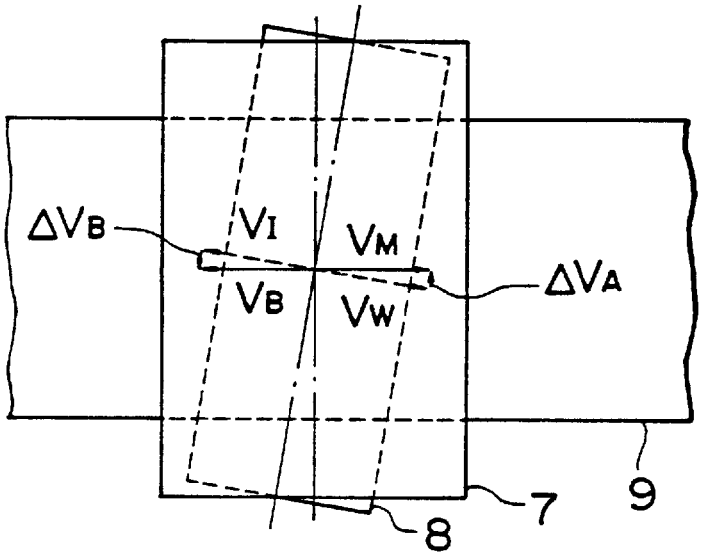
FIG. 8 is a view as seen when looking at the rolls from above, illustrating the direction of the thrust generated by crossing the work rolls in the work roll crossing type four high rolling mill.
Figure 9:
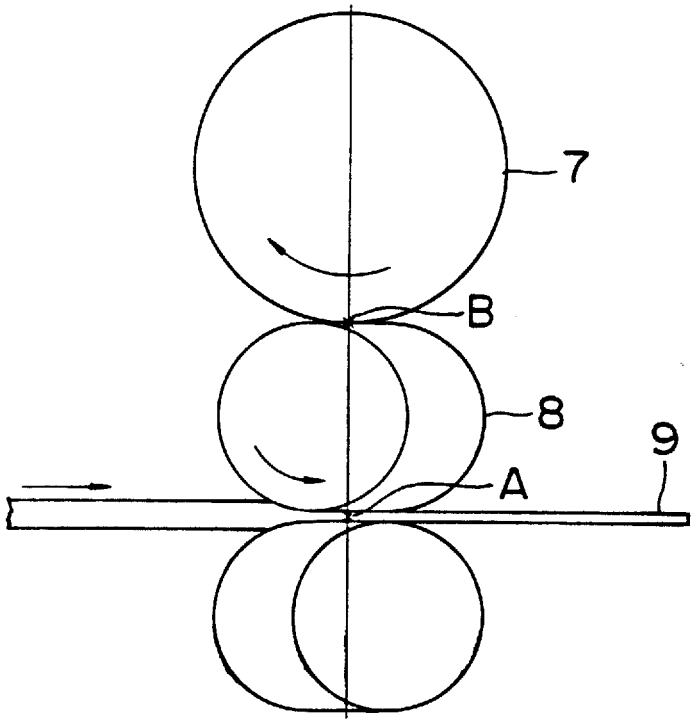
FIG. 9 is a view as seen when looking the rolls in the axial direction thereof, illustrating the direction of the thrust generated by crossing the work rolls in the work roll crossing type four high rolling mill.

FIG. 8 shows the relation between the speed at a contact portion A between the work roll 7 and the material being rolled 9 and that at a contact portion B between the work roll 7 and the back-up roll 8 shown in FIG. 9. $V_M$ indicates the speed of the material being rolled at the contact portion, $V_W$ indicates the peripheral speed of the work roll, and $V_B$ indicates the peripheral speed of the back-up roll.

The work roll 7 is subjected to both the thrust in a direction of a relative speed $\Delta V_A$ between the work roll 7 and the material being rolled 9 and the thrust in a direction of a relative speed $\Delta V_B$ between the work roll 7 and the back-up roll 8. Since the directions of these relative speeds are opposite to each other, these thrusts cancel each other.

At the contact portion A, the material 9 is rolled and the thrust thereby reduces, that is, $\mu_{Tm}$ shown in FIG. 6 reduces. In spite of that, in the case of water spray, direction of $\mu_{WT1}$ is opposite to that of $\mu_{Tm}$, that is, since the thrust exerted from the back-up roll 8 is large, $\mu_{WT1}$ is about 25%. In a practical rolling mill, the thrust must be 5% or less due to the designing of the thrust bearing. In this method, such a thrust therefore cannot be achieved. Also, wear of the back-up roll and that of the work roll are great. In the case of the supply of the lubricating oil having a low concentration, $\mu_{WT2}$ is 2% or less, which is almost the same as that obtained in the normal rolling. When the concentration of the lubricating oil is increased, although the direction of $\mu_{WT3}$ is the same as that of $\mu_{Tm}$, the value is reduced to half of $\mu_{Tm}$. Thus, it is possible to reduce the thrust to values obtained in the normal type of rolling mill in which the work rolls do not cross each other by adequately setting the concentration of the lubricating oil.

Although $\mu_{TR=\mu}$Tm is the most desirable from the viewpoint of reduction in the thrust exerted to the work roll, $\mu_{TR}<\mu_{Tm}$ is desirable from the viewpoint of elimination of wear of the roll.

Figure 10:
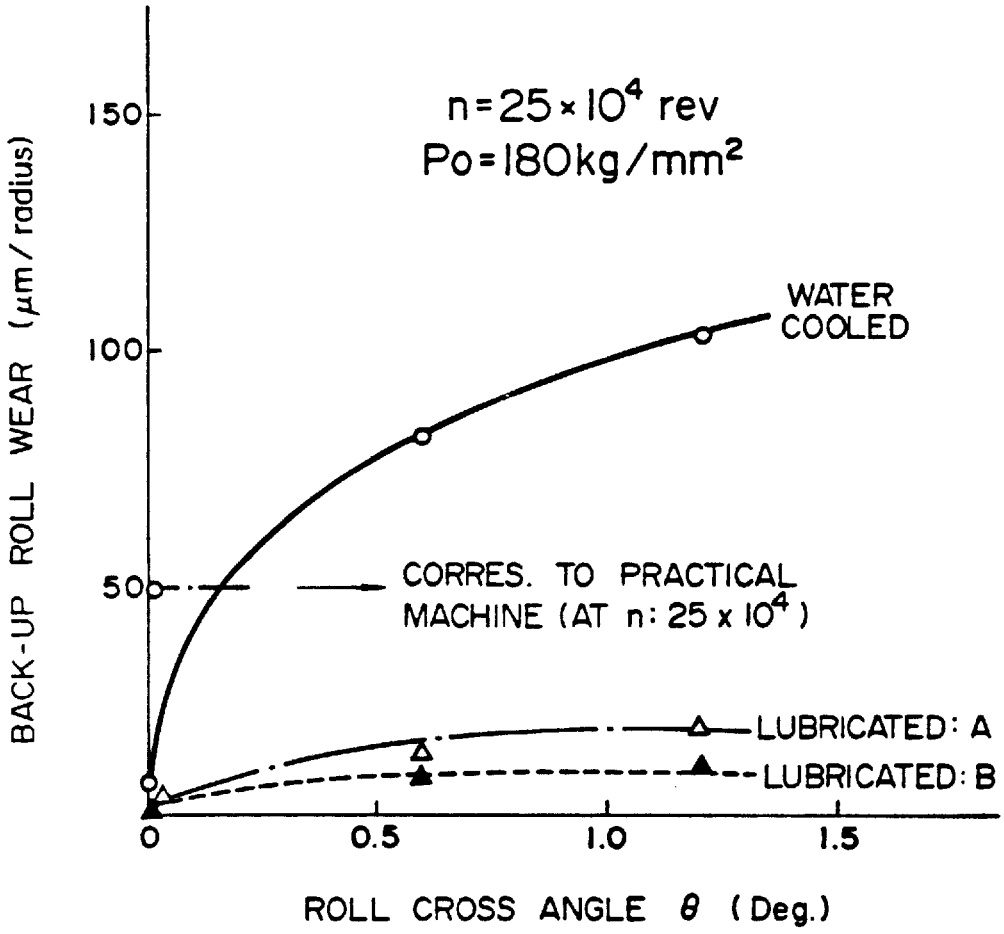
FIG. 10 is a graph showing the relation between the cross angles of the work rolls which differ depending on the type of roll lubricant supplied between the rolls in the work roll crossing type four high rolling mill, which is the embodiment of the present invention, and the wear of back-up roll.

FIG. 10 shows the results of the experiments in which wear of the back-up roll 8 was greatly reduced by lubrication between the work roll 7 and the back-up roll 8 from the lubricant supply nozzle 1. The material of the back-up rolls 8 was a special steel having a hardness of HS60°, while that of the work rolls 7 was high chrome of HS75°. The contact stress $P_o$ between the rolls was 180 kg/mm. The total number of rotations was 250,000. The cross angle between the rolls was 0, 0.6° and 1.2°. In the hot strip mill, when the back-up roll used in the finish front stage mill has been rotated 200,000 times, it is replaced with a new one. The back-up roll in the finish rear stage is rotated 200,000 times before it is replaced with a new one. As can be seen from FIG. 10, when the lubricant is supplied, wear of the back-up roll can be reduced to ⅕th through 1/10th of that obtained when water is supplied. In the normal four high rolling mill in which the rolls do not cross each other, several tens of μm of wear occurs on the back-up roll due to the scale which flies from the material being rolled or the like by the time the roll has been rotated 250,000 times. The wear which occurs when the work rolls cross each other may also be considered the sum of the wear which occurs in the conventional case and that shown in FIG. 10. However, lubrication is effective to reduce the conventional wear as well.

By adapting the aforementioned lubrication method, all the problems of the conventional cross mill can be solved. Furthermore, the structure therefore is simple. In other words, the knowledge about lubrication between the rolls has turned crossing of the rolls, which is conventionally a negative, into a positive.

In the conventional pair cross mill, since the relation between the back-up roll and the work roll is not affected by crossing, distribution of contact pressure between the rolls remains the same. In the rolling mill in which only the work rolls 7 cross each other, it may be considered that an equivalent cross will occur between the rolls, increasing the pressure at the central portion. However, it does not happen for the following reason. When the roll surface length is 2000 mm, the diameter of the work roll 7 is 700 mm, the diameter of the back-up roll 8 is 1500 mm, and the cross angle of the work roll 7 is 1.2°, gap CR of the end portions of the two rolls is expressed as follows:

[Equation 1]

$$C_R = \frac{\delta 2}{2(R_1 + R_2)} \qquad \text{Equation 1}$$

$$\delta = \frac{L = 1.2}{\theta 2 = 57} \times \frac{2000}{2} = 21(\text{mm})$$

$$C_R = \frac{21^2}{2(350 + 750)} = \frac{441}{700 + 1500} = 0.200 \text{ mm}$$

where $R_1R_2$ are respectively the radius of the work roll 7 and that of the back-up roll 8.

This gap corresponds to that obtained when 0.40 mm of crown is grounded onto the back-up roll 8. In a practically employed mill, a safe operation is assured even when a crown of 1 mm or more is provided.

A cross angle of 1.2° is enough to assure the sufficient controllability. Moreover, it can assure the advantage resulting from a change in the crown of the back-up roll 8 (it has been estimated that a cross angle of 1.2° is 10 to 20% more advantageous. Therefore, the cross angle θ can be less than that in the pair cross mill.

The second requirement of the work roll crossing type rolling mill is lubrication between the rolls.

The results of the experiments conducted to examine the effect of the lubricating oil will be described below. In recent years, a so-called hot rolling oil (at a concentration of 1% or less) has been used in the hot rolling for the purpose of reducing wear of the work rolls and rolling load and rolling power. This hot rolling oil is characterized in that it can maintain its lubricating effect on a high-temperature material present in the roll bite of 700° C. or above, and contains a large amount of fatty oil, such as beef tallow. A lubricating oil mainly composed of a mineral oil, which may be a soluble oil containing an emulsifier, greatly degrades or loses the lubricating effect at high temperatures, and thus has no adverse effect on biting.

Figure 11:
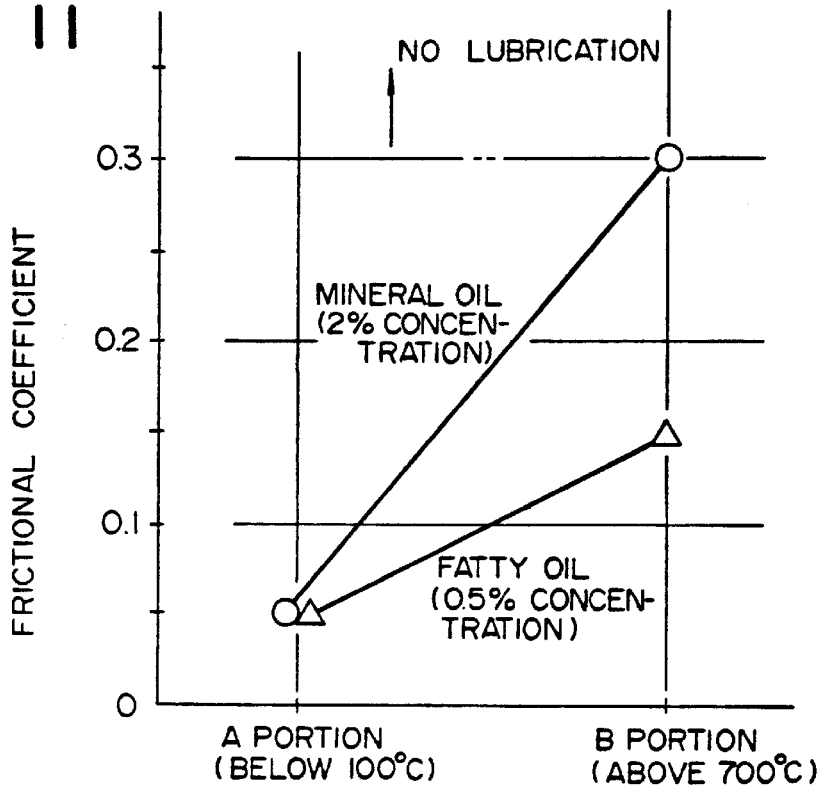
FIG. 11 Is a graph showing the results of the experiments conducted to examine how the lubricating property (frictional coefficient) changes by the temperature of the lubricant.
Figure 12:
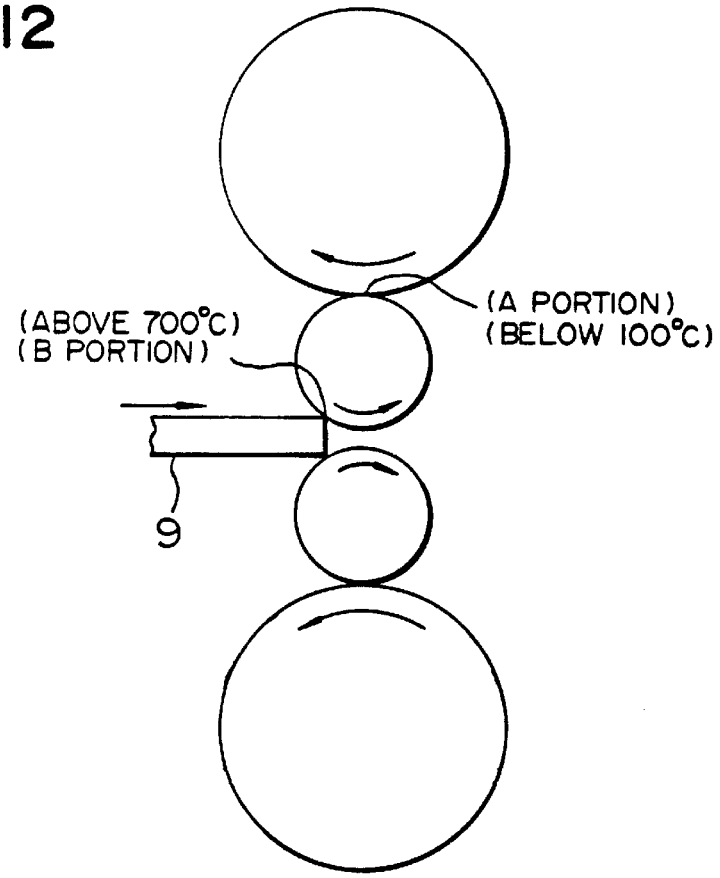
FIG. 12 is a view as seen when looking in the axial direction of the roll, illustrating the experiments shown in FIG. 11.

This will be discussed in detail using the results of the experiments shown in FIG. 11. In FIG. 11, (A portion) and (B portion) respectively correspond to (A portion) and (B portion) in FIG. 12. That is, a mineral oil type lubricant oil (including soluble oils) has a very low lubricating performance which ensures a frictional coefficient as high as that obtained when lubrication is not provided at (B portion) at which it is in contact with the material being hot rolled, but shows a good lubricating performance which ensures a low frictional coefficient at (A portion) of low temperatures. An example of the lubricant oil is "Daphne Roll Oil SL-2" (trade name) manufactured by IDEMITSU KOSAN, Japan. The lubricant is based on mineral oil, includes a special emulsifier, an oilness-improving material and an anti-corrosion material and has the following physical properties:

| | | |
|---|---|---|
| Specific Gravity | 15/4° C. | 0.9295 |
| Color Order | (ASTM) | 20 |
| Flash Point | (COC)° C. | 164 |
| Coefficient of Viscosity cSt | @ 40° C. | 22.94 |
| | @ 100° C. | 4.11 |
| Viscosity Index | | 58 |
| Fluidizing point | °C. | −175 |
| Total Acid Value | mg KOH/g | 3.58 |
| Residual Carbon | wt % | 0.5 |
| Ash | wt % | 0.17 |
| Saponification Value | mg KOH/g | 12.30 |
| Copper Plate Corrosion | (100° C. × 3 h) | 1 |

A fatty oil type lubricating oil, such as beef tallow, has a lubricating performance not only at (A portion) but also at (B portion) of high temperatures. Hence, presence of this type of lubricating oil when biting of the material to be rolled begins may generate biting failure.

Therefore, the use of the fatty oil type lubricating oil causes no problem in the continuous hot strip mill. However, in the hot strip mill in which the materials to be rolled are supplied in sequence, the lubricant attached to the work roll 7 may cause bite failure. Furthermore, when acceleration or deceleration is performed after the material has left the roll, since the rolling load has been reduced to zero, a small coefficient of friction between the rolls may cause slip between the rolls due to inertia of the reinforcing roll 8. Hence, the coefficient of friction of the roll surface must be increased immediately before the material leaves the roll, and supply of lubricant must thus be suspended before the material leaves the roll. In that case, it is desired that supply of lubricant be continued as long as possible until immediately before the rolled material leaves the roll.

Figure 13:
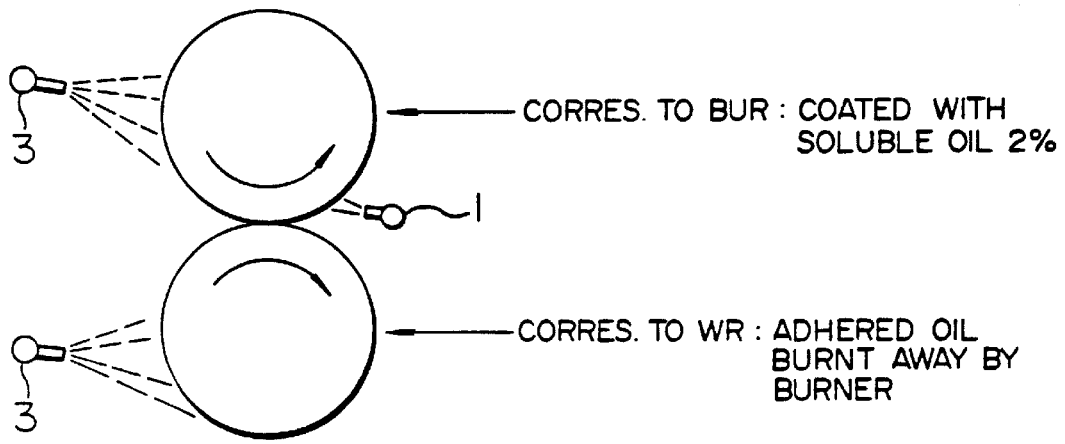
FIG. 13 schematically illustrates how a lubricant and a coolant are supplied to a work roll and a back-up roll.
Figure 14:
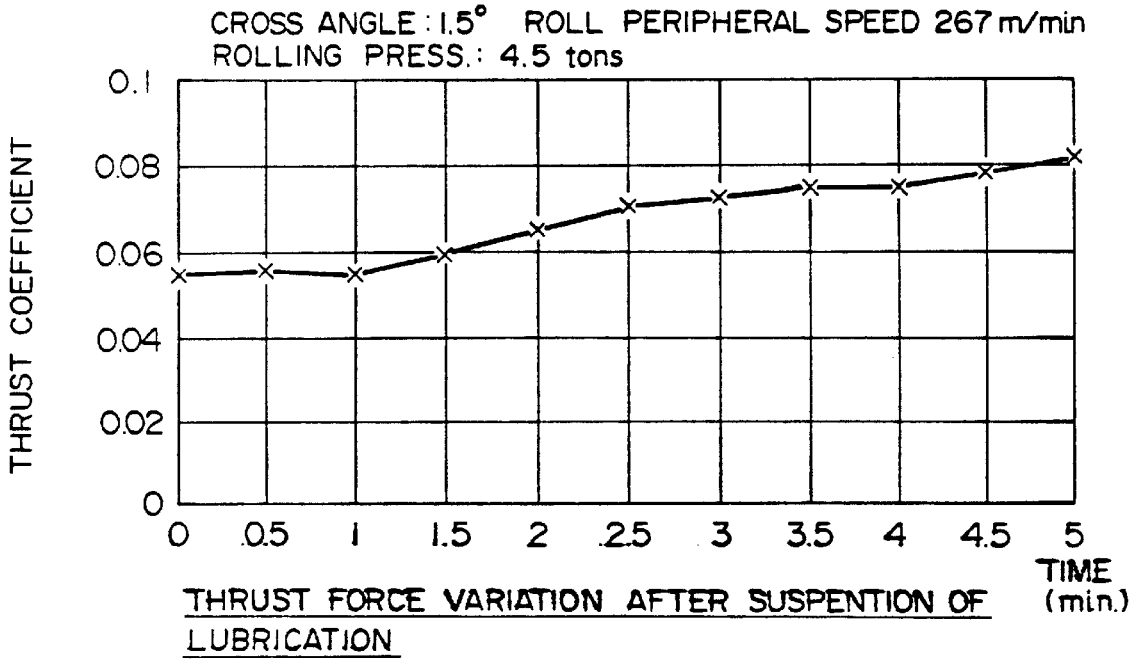
FIG. 14 is a graph showing the results of experiments conducted to show that the lubricating property can be maintained after supply of the lubricant is suspended.

When supply of the lubricant from the lubricant supply nozzle 1 shown in FIG. 13 is suspended, the lubricating effect does not disappear immediately after suspension, as shown in FIG. 14. Although the thrust coefficient (thrust) starts increasing in about one minute after suspension, the degree of increase is small and the amount of increase is only 0.025 in five minutes after suspension. Generally, it takes about one to three minutes for bite of a subsequent material to be rolled to be started after the trailing end of the previous material has left the roll, and the lubricant effect can thus be maintained sufficiently long.

The method of suspending supply of the lubricant will be described with reference to FIG. 5 which illustrates a control system.

First, a signal representing the rolling conditions is input to a lubricant controller 50 before the length 1 of the trailing end of the material being rolled 9 is $\pi/2D_W$, by which the lubricant controller 50 outputs an operation signal to the change-over valve 28 to close the lubricant supply nozzle 1. At that time, the lubricant already attached to half of the circumference $\pi/2D_W$, of the work roll 7 by that time is carbonized by the hot rolled material 9 and thereby loses its lubricating ability. However, the lubricant attached to the back-up roll 8 is not brought into direct contact with the rolled material 9 and thus remains on the back-up roll. Therefore, the lubricant effect between the work roll 7 and the back-up roll 8 can be maintained, and lubrication can thus be provided between the rolls during rolling and non-rolling.

If a lubricant of the type which can be washed by the cooling water supplied from the roll cooling nozzles 2 and 3 is selected, the aforementioned arrangement is not necessary and application of lubricant can be performed throughout the rolling. That is, when acceleration or deceleration is performed after the rolled material leaves the roll, lubricant supply is suspended, the work rolls are retracted to a position where the cross angle is 0, and then roll balancing force is increased. Because of crossing of only the work rolls 7, crossing resistance is less and crossing operation can be quickly performed during rotation of the rolls. Therefore, reduction of the cross angle to zero after the rolled material 9 has left the roll is desired.

When the mineral type lubricant is used, supply thereof can be continued, as mentioned above. Alternatively, both the fatty oil type hot rolling oil and the mineral lubricating oil can be used. That is, it can be arranged such that only the hot rolling lubricating oil is supplied when the material being rolled is present in the rolling mill while only the mineral type lubricating oil is supplied when the material is absent. In this way, lubrication between the rolls can be maintained throughout the operation without deteriorating biting of the materials to be rolled.

Lubrication performed in the hot rolling process has been described. In the cold rolling process, however, the lubricant is kept supplied, and the problem involving bite does not occur. Hence, the objective of the lubrication can be achieved by supplying an adequate type of lubricant between the back-up roll 8 and the work roll 7.

Wear of rolls, which would be caused by a great degree due to slippage of rolls when only water is supplied between the rolls, can be greatly reduced by supply of the lubricant in the manner mentioned above. However, this increases the degree at which the central portion of the roll wears. Hence, the on-line grinder 6 shown in FIG. 5 is used to grind the outer surface of the back-up roll 8 such that it is straight or has a predetermined crown.

On-line grinders for grinding the work roll 7 which is frequently replaced with a new one have been proposed. However, maintenance of the work roll 7 is very difficult, because the work roll 7 is very hard, because high quality is required for the finish of the surface, and because the space is not enough due to provision of guide or cooling water. In the case of the back-up roll 8, polishing is not so difficult, because there is enough space is enough, because the roll is not so hard as the work roll, and because a surface quality as high as that for the work roll is not required. Even when correction of roll profile is not necessary, the back-up roll 8 is replaced for polishing because a fatigue layer generated by the contact of two rolls due to Hertz's stress must be removed. Therefore, if profile correction and removal of the fatigue layer can be performed at the same time, the roll exchange pitch of the back-up roll 8 can be greatly increased. Changing of the back-up roll 8 is so difficult that it is generally conducted at the periodic repair. In a practical operation, changing of the back-up roll is conducted periodically. The use of the aforementioned method, however, allows the polishing work of the back-up roll 8 conducted by the rolling plate to be eliminated. In that case, the rolling plant performs polishing of the back-up roll 8 using the on-line grinder without using an expensive large back-up roll grinder. The back-up roll grinder can be employed for the back-up roll not only in the aforementioned work roll cross type four high mill but also in all types of mills, such as four, five or six high mill. Regarding shift of the cross point due to backlash of the roll bearing, the largest backlash occurs in a gap between the metal chock of the roll and the stand 20 or project block 30. The crossing mechanism for the work rolls 7 may be provided with a mechanism for reducing backlash. In the case of the back-up roll 8, since the gap thereof is normally fixed, it is set to a small value during rolling and to a large value during roll changing in this invention. Alternatively, the chock of the back-up, roll 8 may be pressed against the stand on one direction under a fixed hydraulic pressure during rolling while pressing is released during roll changing.

Figure 15:
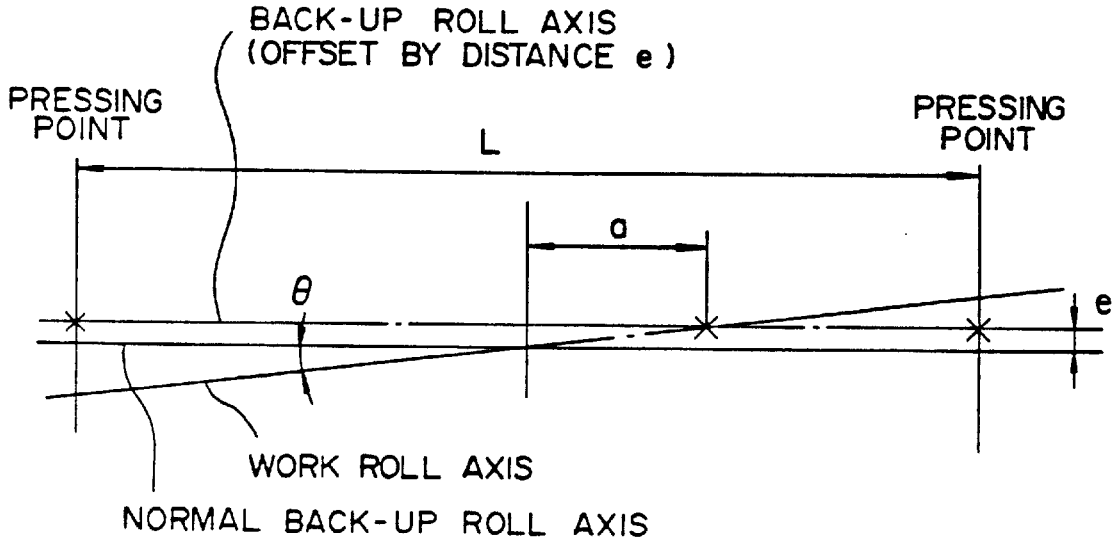
FIG. 15 a schematic view of the roll axis as seen when looking from above, illustrating an influence of the shift of the axis of a back-up roll which is generated by crossing the work roll in the work roll crossing type four high rolling mill.
Figure 16:
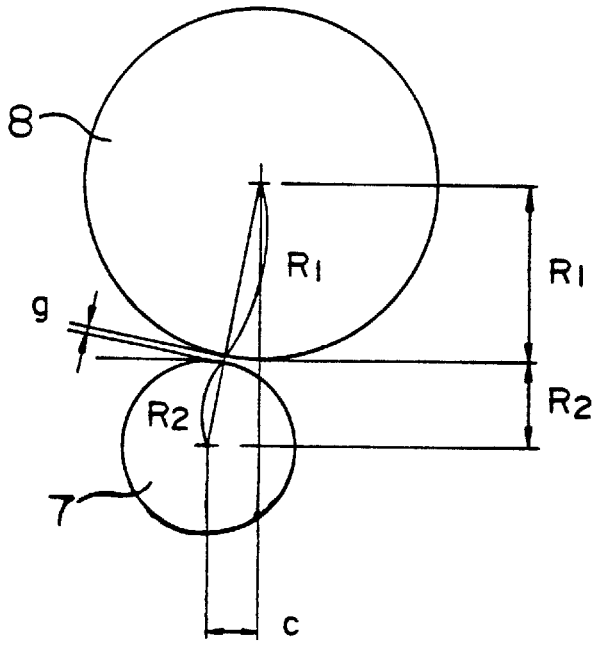
FIG. 16 is a schematic view of roll axes as seen when looking in the axial direction thereof, illustrating an influence of the deviation of the axis of the back-up roll which is generated by crossing the work roll in the work roll crossing type four high rolling mill.

The need for such a structure will be discussed with reference to FIGS. 15 and 16.

Inclination of the back-up roll 8 about the crossing center of the work roll 7 due to the backlash between the bearing of the back-up roll 8 and the stand 20 may cause slight displacement of the cross angle of the work roll 7 but causes no serious problem. However, displacement of the axis of the back-up roll 8 by e in the direction of rolling shifts the cross point of the two rolls in the axial direction by $a=e/\theta$, generating a difference in the gaps of the upper and lower work rolls 7 which leads to zigzagging of the material being rolled 9. To eliminate this, the reduction level must be corrected by $S_{df}$. Where $R_1$ is the radius of the work roll 7, $R_2$ is the radius of the back-up roll 8, and L is the distance between the reduction screws, offset of the center of the two rolls by c, shown in FIG. 16, increases the roll pass g to $c2/2(R_1+R_2)$, thus increasing the difference G in the gaps at the right and left reduction positions as follows:

[Equation 2]

$$G = \frac{1}{2(R_1+R_2)}\left[\left\{\left\{\left(\frac{L}{2}+a\right)\theta\right\}^2 - \left\{\left(\frac{L}{2}-a\right)\theta 3\right\}^2\right]\right. = \frac{La\theta^2}{R_1R_2} = \frac{Le\theta}{R_1+R_2} \quad \text{Equation 2}$$

A reduction screw difference $S_{df}$ corresponding to G is obtained by the following equation.

[Equation 3]

$$S_{df} = \frac{L}{R_1+R_2\cdot e\theta} \quad \text{Equation 3}$$

In a large hot strip mill, if $R_1=700/2=350$ mm, $R_2=1500/2=750$ mm, L=3000 mm and $\theta=1.20$, $S_{df}$ is obtained by the following equation in which the unit of e is mm.

[Equation 4]

$$S_{df}=0.05e \quad \text{Equation 4}$$

Since it is practically impossible to correct $S_{df}$, i.e., the reduction level, according to e, e must be reduced to a value which can be neglected in a practical operation. From the experiences, in the case of the hot strip finish mill which rolls thick strips, $S_{df}$ in the front stage mill stand is 0.05 mm, and that in the rear stage 30 mill stand is about 0.025 mm. At that time, the allowable displacement e of the center of the back-up roll in the front stage mill stand is ±1 mm, and that in the rear stage mill stand is ±0.5 mm. However, the smaller, the better.

In the presently practiced hot strip mill, schedule free rolling is the important element, and shift of the work rolls in the axial direction is essential in order to disperse wear thereof. Therefore, crown control capability and wear dispersion function are the requirements of the hot strip mill. In this embodiment, since the force exerted to the work roll 7 in the axial direction can be reduced, the work roll shifting mechanism can be made simple.

Figure 17:
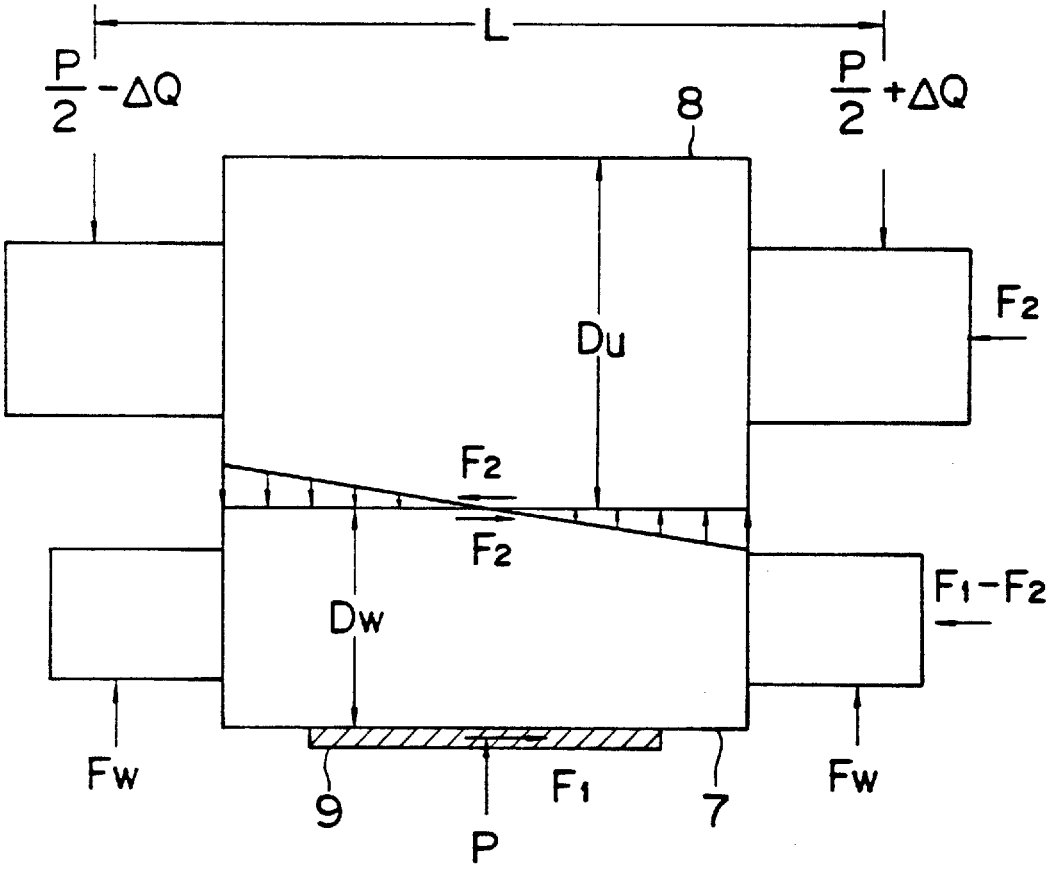
FIG. 17 is a schematic view explaining a difference in the forces applied to the hydraulic jacks on the operating and driven sides of the rolling mill, which are generated on the basis of the thrust generated by crossing the work roll in the work roll crossing type four high rolling mill.

Difference of the force applied to the jack by the thrust will be explained. In FIG. 17, when thrust $F_1$ is applied from the material being rolled while thrust $F_2$ is generated between the rolls, a load difference ΔQ occurs between the right and left jacks. ΔQ is obtained in FIG. 17 as follows:

[Equation 5]

$$\Delta Q = \frac{1}{1}\left\{\frac{1}{2}(F_1+F_2)D_W+\frac{1}{2}F_2D_B\right\} \quad \text{Equation 5}$$

$$\text{If } L = 3000 \text{ mm}, D_W = 700 \text{ mm}, D_B = 1500 \text{ mm},$$

$$F_1 = F_2 = 0.05 \times P, \text{ i.e. , if thrust is 5\%},$$

[Equation 6]

$$\Delta Q = 0.0.24P \quad \text{Equation 6}$$

That is, 2.4% of the rolling load is generated. If the thrust is 10%, ΔQ reaches 4.8%.

Hence, reduction in the thrusts $F_1$ and $F_2$, particularly, thrust $F_2$ between the rolls, is advantageous.

Difference in the reduction forces adversely affects correction of zigzagging, because in the correction a difference in the loads is detected and reduction forces are adjusted such that difference is reduced to zero. Although it is possible to perform correction of zigzagging using load difference ΔQ obtained from the thrust and stored beforehand, variations in the thrust causes disturbance of zigzagging correction, and reduction in the thrust as must as possible is thus desired.

The operation of the aforementioned embodiment, which is the work roll cross type four high rolling mill, will be described below.

Referring to FIGS. 1 and 2, the upper and lower work rolls 7 which roll the material to be rolled 9 are pressed from two sides thereof by means of the hydraulic jacks 10 and 11 such that the axes thereof are respectively inclined by θ in the opposite directions. During rolling, the work rolls 7 are maintained at that position. The cross angle of the work roll 7 will be set in the manner described below. The sensor 13 provided on the hydraulic jack 10 through the rod 12 detects the stroke of the jack, i.e., the position of the work roll chock 16. The other hydraulic jack 11 presses the work roll chock 16 by a pressing force which is adjusted by the pressure reduction valve 15. After the cross angle of the work roll is set with the change-over valve 14 opened, the change-over valve 14 is closed to maintain the set cross angle.

The chocks 17 of the back-up rolls 8 which hold the work rolls 7 are pressed against the window surfaces 20*a* of the stand 20 which are remote from the hydraulic jacks 19 by means of the hydraulic jacks 19 through the pressing plates 18 during rolling so that the back-up rolls 8 can be held in a fixed state. A work roll 7 shifting device will be described in detail below. The chock 16 of the work roll 7 is held by the movable block 21. The chock 16 can be shifted, together with the movable block 21, in the axial direction of the work roll 7 while being guided by a fixing frame 23 by means of the hydraulic cylinders 22 incorporated in the movable block 21. Since the chock 16 of the work roll 7 is shifted toward the direction of rolling as a result of crossing, the movable block 21 must be rotated according to the position of the chock 16. Hence, the guiding portion of the fixed frame 23 is made cylindrical so that it can follow the roll crossing operation.

To compensate for wear of the back-up roll 8 caused by relative slide speed $\Delta V_B$ (FIG. 9) generated between the rolls by making the work rolls 7 cross each other, the roll grinder 6 shown in FIG. 3 is provided. The grinder 6 moves together with the drive motor 24 in the axial direction of the back-up roll 8 while polishing the surface of the back-up roll 8, by which the roll surface is polished in a straight or curved fashion. Lubrication of the roll surface will be described below with reference to FIG. 5. Coolant is supplied to the work roll from the roll cooling nozzles 2 and 3 to cool the work roll. A lubricant of an adequate concentration is supplied to the vicinity of the entrance of the pass between the work roll 7 and the back-up roll 8 from the lubricant supply nozzle 1 in order to reduce the thrust between the rolls. The lubricant is supplied to the lubricant supply nozzle 1 from the tank 26 by the pump 27 through the change-over valve 28. Thus, supply of the lubricant can be suspended at suitable times, e.g., when the material being rolled leaves the roll or when the material to be rolled is supplied to the roll, by closing the change-over valve 28.

The most desirable position to which the lubricant is supplied from the lubricant supply nozzle 1 is shown in FIG. 5. However, a lubricant may also be supplied to other positions, e.g., to the circumference of the back-up roll 8, so that it can be finally supplied between the rolls therefrom.

As will be understood from the foregoing description, the work roll cross type four high rolling mill according to the present embodiment is capable of overcoming the drawbacks caused by making only the work rolls cross each other and can thus be put into practical use.

The mechanisms and structures which are necessary to accomplish the necessary functions have been described. It is, however, to be noted that the object of the present invention can also be achieved by other similar mechanisms. For example, a worm jack or a wedge mechanism may be used in place of the hydraulic jack to achieve crossing of the work rolls 7.

The aforementioned work roll cross type four high rolling mill can be provided by revamping an existing four high rolling mill without providing a new stand by reusing the stand 20 of the existing rolling mill. The existing four high rolling mill in which the pair of work rolls 7 and the pair of back-up rolls 8 for respectively supporting the work rolls 7 are provided on the rolling stand 20 will be revamped into the work roll cross type four high rolling mill in the manner described below the hydraulic jacks 10 and 11, which are the hydraulic device that can be operated in the direction in which the material to be rolled 9 is fed, are provided at the positions on the rolling stand 20 which oppose the roll chocks 16 of the work rolls 7 so that the work rolls 7 can be inclined relative to the back-up rolls 8 on the horizontal plane in such a manner that the axes of the work rolls 7 cross the axes of the back-up rolls 8 and such that the axes of the work rolls 7 cross each other. Also, the hydraulic cylinders 22, which are the hydraulic devices that can be operated in the axial direction of the work roll 7, are provided so that the engagement of the hydraulic cylinders 22 with the roll chock 16 of the work roll 7 enables the work roll 7 to be moved in the axial direction thereof. The lubricant supply device 1 for supplying a lubricant is provided between the work roll 7 and the back-up roll 8.

Thus, a rolling mill, in which crossing of only the work rolls 7 is provided, can be obtained by utilizing the stand 20 of the existing rolling mill. In this rolling mill, since the work rolls 7 can be moved in the axial direction thereof during rolling, schedule free rolling is allowed for. Furthermore, since the thrust exerted to the work roll 7 can be reduced to a degree which does not cause problems even when the work rolls 7 cross each other by the action of the lubricant supplied from the lubricant supply device 1 between the work roll 7 and the back-up roll 8, the rolling roll can show an excellent ability with which it controls crown of the materials to be rolled 9.

An example of application of the aforementioned work roll cross type four high rolling mill to the hot rolling system will be described below with reference to FIG. 18.

Figure 18:
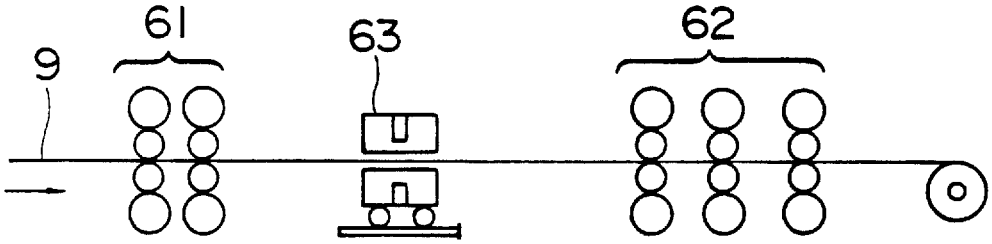
FIG. 18 is a schematic view of a hot rolling system which employs, as the finish rolling mill, the embodiment of the work roll crossing type four high rolling mill according to the present invention.

FIG. 18 shows a hot rolling system in which a joining device 3 is provided between rough rolling mills 61 and finish rolling mills 62 for sequentially joining the materials being rolled 9, and in which after the materials which have been rolled by the rough rolling mills 61 are joined to each other by the joining device 63, the joined materials are continuously rolled by the finish rolling mills 62. At least one of the finish rolling mills 62 is constituted by the aforementioned rolling mill which includes the pair of work rolls 7 and the pair of back-up rolls 8 for respectively supporting the work rolls 7, in which the axes of the back-up rolls 8 are not inclined on the horizontal plane while the work rolls 7 can be inclined relative to the back-up rolls 8 on the horizontal plane such that the axes of the work rolls 7 cross the axes of the back-up rolls 8 and such that the work rolls 7 cross each other, in which the work rolls 7 are movable in the axial direction thereof, and in which the lubricant supply device 1 for supplying a lubricant between the work roll 7 and the back-up roll 8 is provided.

Thus, it is possible to provide a rolling mill in which crossing of only the work rolls 7 is provided.

Furthermore, since the work rolls 7 are movable in the axial direction thereof, they can be moved in the axial direction during rolling, thus making schedule free rolling possible.

Furthermore, since the lubricant supply device 1 for supplying a lubricant between the work roll 7 and the back-up roll 8 is provided, the thrust exerted to the work roll 7 can be reduced to a degree which causes no problem in a practical operation even when the work rolls are made to cross each other by the action of the lubricant supplied between the work roll 7 and the back-up roll 8. It is therefore possible to provide a work roll cross type rolling mill which shows an excellent ability with which it controls crown of the material to be rolled 9.

Thus, the work roll cross type rolling mill can be used as the finish rolling mill of the hot rolling system in which the materials rolled by the rough rolling mills are continuously rolled by the finish rolling mills.

The aforementioned rolling mill according to the present embodiment has a simpler structure than the conventional pair cross type four stage mill but is capable of controlling crown of the sheet more effectively. The aforementioned rolling mill has another advantage in that it can greatly reduce the thrust exerted to the work roll, which is the utmost requirement of the cross type mill. Consequently, the thrust bearing can be made simple, reduction in the diameter of the work roll is made possible, and shift of the work roll is facilitated. The last one is essential in the continuous rolling operation in which the work roll must be shifted during rolling. In the pair cross type rolling mill, changes in the cross angle during rolling require relative movement between the reduction device and the bearing of the back-up roll, and a more complicated structure is thus required. However, in the present embodiment, changes in the cross angle can be easily and quickly performed because they are the changes in the cross angle of the rotating rolls. Therefore, the present embodiment is suited to continuous rolling. Also, wear of the rolls, which would be caused by the slip of the rolls, can be greatly reduced by the use of an adequate lubricant. The use of the on-line grinder improves the problem involving the wear and allows for removal of the fatigue layer, and hence greatly increases the pitch of the back-up roll changing operation which is a troublesome task.

An additional embodiment of the present invention will be described hereunder with reference to FIG. 19 wherein reference numerals the same as or similar to those used to denote elements of the preceding embodiments of the invention represent the identical or similar elements of the additional embodiments of FIG. 19.

Figure 19:
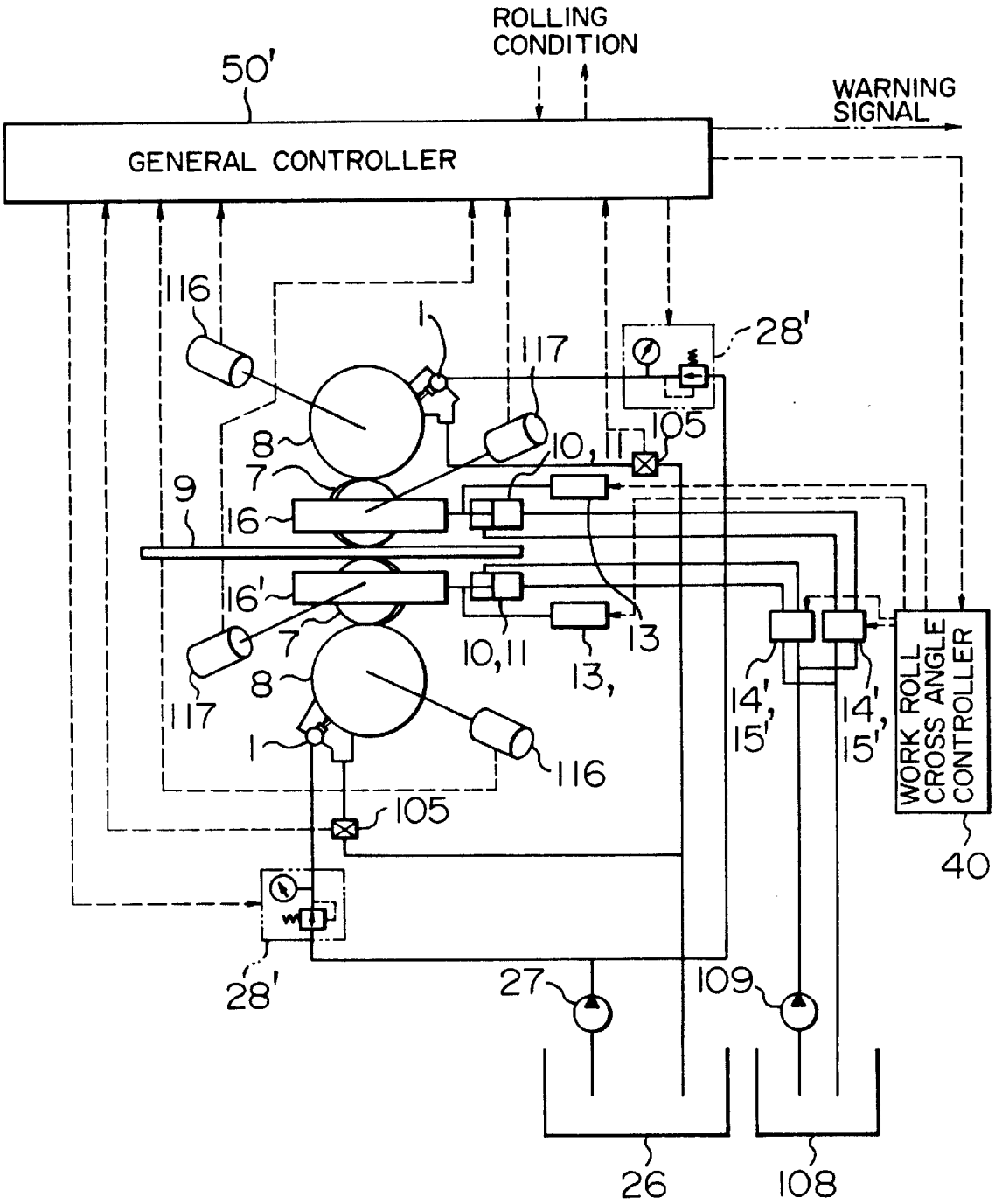
FIG. 19 is a schematic illustration of an additional embodiment of the present invention.

The embodiment of the rolling mill shown in FIG. 19 is provided with work roll chocks 16 connected to the opposite ends of work rolls 7 and respectively adapted to be shifted by hydraulic cylinders 10 and 11 in the direction of the pass of a strip 9 to be rolled so that the axes of the work rolls 7 can cross each other and also cross the axes of back-up rolls 8 to control the crown of the strip 9 to be rolled. The rolling mill is also provided with a lubricating system for providing lubricant between each of the work rolls 7 and an associated back-up roll 8 to suppress increase in the thrust forces which would otherwise be caused due to the crossing of the rolls. The lubricating system includes lubricant headers 1 respectively disposed adjacent the back-up rolls 8 for providing lubricant between each back-up roll 8 and the associated work roll 7.

Lubricant oil is supplied by a pump 27 from a tank 26 is to the headers 1. A surplus part of the thus supplied lubricant oil that has not been adhered to the rolls is returned to the tank 26 so as to be circulated again. The pressure at which the lubricant oil is sprayed from the headers 1 is set by pressure regulators 28' based on a command signal from a general controller 50'. Lubricant flow detectors 105 are provided in lubricant return lines so as to assure that the lubricant oil is reliably supplied. Accordingly, when th e general controller 50' generates a command signal representative of a spraying pressure of, for example, 5 kg/ $cm^2$ based on a rolling condition, the pressure regulators 28' are so adjusted as to set this pressure level as a spraying pressure at which the lubricant oil is sprayed from the headers 1.

In an event where, due to some reason such as a failure of the lubricant pump 27, the lubricant supply lines cannot be kept at a pressure level higher than the lowest pressure necessary for the lubricant to be sprayed, for example, 3 $kg/cm^2$, with resultant pressure drops at the outlet sides of the pressure regulators 28' beyond the lowest necessary pressure levels, or with resultant decreases in the rates of the flows of lubricant through the flow detectors 105 beyond predetermined minimum flow rates, the general controller 50' actuates a buzzer or lamp (not shown) to warn an operator of the abnormal condition. Simultaneously, the general controller 50' feeds a signal to a work roll cross angle controller 40 to control servo valves 14', 15', which control hydraulic cylinders 10, 11 to adjust the positions of the work roll chocks 16 for thereby adjusting the cross angles of the work rolls 7, such that the cross angles of the work rolls are reduced to zero (0) while the work roll cross angles are detected by the cross angle detectors 13 and fed back to the general controller 50'. Pressurized fluid supplied to the hydraulic cylinders 10, 11 is fed from a tank 108 by a pump 109.

Moreover, there is a possibility that an insufficient lubrication occurs during rolling due to deterioration of the quality of the lubricant oil with a resultant increase in the thrust force even if the pressure or the flow rate of the lubricant oil is higher than the minimum necessary level. The back-up rolls 8 and the work rolls 7 are provided with thrust force detectors 116 and 117. In the event where any one of the thrust force detectors detects an abnormally high thrust force, the general controller 50' operates to raise the pressure at which the lubricant oil is fed and also increase the rate of the lubricant flow through each lubricant supply line. In addition, if the abnormally high thrust force is not lowered, the general controller further operates to reduce the work roll cross angles to zero (0) as in the case of the pressure drop of the lubricant oil or the decrease in the lubricant flow rate.

It is possible according to the first aspect of the present invention to provide a work roll crossing type rolling mill which shows an excellent ability with which it controls crown of the material to be rolled, and which achieves reduction in the thrust exerted to the work roll with a simple structure.

It is also possible according to the second aspect of the present invention to provide a work roll crossing type rolling mill which shows an excellent ability with which it controls crown of the material to be rolled, which achieves reduction in the thrust exerted to the work roll with a simple structure, and which allows for schedule free rolling.

It is also possible according to the third aspect of the present invention to provide a work roll crossing type rolling mill which shows an excellent ability with which it controls crown of the material to be rolled, which achieves reduction in the thrust exerted to the work roll with a simple structure, and which is capable of preventing generation of excessive thrust between the work roll and the back-up roll.

It is also possible according to the fourth aspect of the present invention to provide a work roll crossing type rolling mill which shows an excellent ability with which it controls crown of the material to be rolled, which achieves reduction in the thrust exerted to the work roll with a simple structure, which allows for schedule free rolling, and which is capable of preventing generation of excessive thrust between the work roll and the back-up roll.

It is also possible according to the fifth aspect of the present invention to provide a hot rolling system including a work roll crossing type rolling mill which shows an excellent ability with which it controls crown of the material to be rolled, which achieves reduction in the thrust exerted to the work roll by a simple structure, and which allows for schedule free rolling.

It is also possible according to the sixth aspect of the present invention to provide a rolling method for a work roll crossing type rolling mill which shows an excellent ability with which it controls crown of the material to be rolled, and which achieves reduction in the thrust exerted to the work roll with a simple structure.

It is also possible according to the seventh aspect of the present invention to provide a rolling method for a work roll crossing type rolling mill which shows an excellent ability with which is controls crown of the material to be rolled, which achieves reduction in the thrust exerted to the work roll with a simple structure, and which allows for schedule free rolling.

It is also possible according to the eighth aspect of the present invention to provide a rolling method for a work roll crossing type rolling mill which shows an excellent ability with which it controls crown of the material to be rolled, which achieves reduction in the thrust exerted to the work roll with a simple structure, and which enables the crown to be changed during rolling.

It is also possible according to the ninth aspect of the present invention to provide a rolling method for a work roll crossing type rolling mill which shows an excellent ability with which it controls crown of the material to be rolled, which achieves reduction in the thrust exerted to the work roll with a simple structure, which allows for schedule free rolling, and which enables the crown to be changed during rolling.

It is also possible according to the tenth aspect of the present invention to provide a revamping method of a work roll crossing type rolling mill which shows an excellent ability with which it controls crown of the material to be rolled, and which achieves reduction in the thrust exerted to the work roll with a simple structure.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A rolling mill in which a pair of work rolls and a pair of back-up rolls for respectively supporting the work rolls are provided on a rolling stand and said work rolls are arranged such that their axes can be inclined in a horizontal plane such that a rolling of a material to be rolled is carried out with the axes of said work rolls crossing each other, wherein:

said back-up rolls are arranged such that the axes of said back-up rolls are disposed in a horizontal plane and fixed in a direction substantially perpendicular to a direction of rolling of said material;

said work rolls are supported such that respective angles of inclination of respective work rolls are controllable so that the axes of said work rolls cross the axes of said back-up rolls and also cross a line perpendicular to the direction of rolling of said material;

said work rolls and said back-up rolls are arranged such that a first thrust force acts from each back-up roll to an associated work roll in a direction opposite to a direction in which a second thrust force acts from said material to the work roll so that an actual thrust force acting on the work roll is equal to a difference between said first and second thrust forces; and a lubricant supply device is provided for supplying an axial thrust reducing lubricant to a zone between each work roll having its axis crossing the axis of an associated back-up roll and the back-up roll with which said work roll is in direct contact, to thereby maintain axial thrust reducing lubrication in said zone, whereby the actual thrust force is reduced by the lubrication in said zone between the work roll and the back-up roll.

2. A rolling mill according to claim 1, wherein said lubricant supply device supplies sufficient lubricant to said zone so that said actual thrust force acting to said work roll under the lubrication in said zone is not greater than 5% of a maximum rolling load acting on material being rolled during rolling operation of said rolling mill.

3. A hot rolling mill according to claim 1, wherein said work rolls are supported such that respective angles of inclination of respective work rolls are controllable with respect to one another and with respect to associated ones of the back-up rolls, said lubricant supply device supplying a mineral oil based lubricant continuously during a rolling operation, said lubricant supply device being so disposed as to be faced at least to the back-up roll.

4. A rolling mill in which a pair of work rolls and a pair of back-up rolls for respectively supporting the work rolls are provided as work roll and back-up roll combinations on a rolling stand, wherein the back-up rolls are constructed in such a manner that axes thereof are not inclined in a horizontal plane while the work rolls are constructed in such a manner that axes thereof can be inclined in a horizontal plane relative to the back-up rolls such that the axes of the work rolls cross the axes of the back-up rolls and such that the axes of the work rolls cross each other, wherein a lubricant supply device is provided for supplying a lubricant between the work roll and the back-up roll of each combination, and wherein a system is provided for controlling an angle at which said work rolls cross each other, said cross angle controlling system including thrust force detectors for detecting thrust forces acting on said back-up rolls and on said work rolls, cross-angle controlling devices for setting and controlling the work roll cross angle, said lubricant supply device including a lubricant header through which lubricant can be sprayed to effect lubrication between the work roll and the back-up roll of each combination, said cross angle controlling system further including lubricant flow rate detector apparatus for detecting rate of flow of the lubricant through said lubricant supply device, devices for detecting and controlling the pressure at which the lubricant is sprayed through said lubricant header, said thrust force detectors being operative to generate a signal either when the thrust force acting on at least one of said back-up rolls exceeds an allowable maximum magnitude determined based on supporting machine structure or when the thrust force acting on at least one of said work rolls exceeds an allowable maximum magnitude determined based on the supporting machine structure, said cross angle controlling system further including a controller responsive to the signal from said thrust force detectors to warn an operator and control said cross-angle controlling system such that the work roll cross angle is reduced.

5. A hot rolling system of the type that has a rough rolling mill and a finish rolling mill, wherein a rolling mill is provided in an upstream stage of said finish rolling mill and comprises a pair of work rolls and a pair of back-up rolls for respectively supporting the work rolls, said work rolls being arranged such that their axes can be inclined in a horizontal plane such that a rolling of a material to be rolled is carried out with the axes of said work rolls crossing each other, wherein:

said back-up rolls are arranged such that the axes of said back-up rolls are disposed in a horizontal plane and fixed in a direction substantially perpendicular to a direction of rolling of said material;

said work rolls are supported such that respective angles of inclination of respective work rolls are controllable so that the axes of said work rolls cross the axes of said back-up rolls and also cross a line perpendicular to the direction of rolling of said material;

said work rolls and said back-up rolls are arranged such that a first thrust force acts from each back-up roll to an associated work roll in a direction opposite to a direction in which a second thrust force acts from said material to the work roll so that an actual thrust force acting on the work roll is equal to a difference between said first and second thrust forces; and a lubricant supply device is provided for supplying an axial thrust reducing lubricant to a zone between each work roll having its axis crossing the axis of an associated back-up roll and the back-up roll with which said work roll is in direct contact, to thereby maintain axial thrust reducing lubrication in said zone, whereby the actual thrust force is reduced by the lubrication in said zone between the work roll and the back-up roll.

6. A method of revamping a 4-high rolling mill of the type that has a pair of rolling stands, a pair of work rolls and a pair of back-up rolls respectively supporting said work rolls, said method comprising the steps of:

providing roll displacing means on at least one of said rolling stands so that said roll displacing means displaces said work rolls such that their axes are inclined in a horizontal plane and such that the angles of inclination of respective work rolls are controlled so that the axes of said work rolls cross each other and cross respective axes of respective ones of the back-up rolls;

arranging said back-up rolls such that the axes of said back-up rolls are disposed in a horizontal plane and fixed in a direction substantially perpendicular to a direction of rolling of said material;

supporting said work rolls such that respective angles of inclination of respective work rolls are controllable so that the axes of said work rolls cross the axes of said back-up rolls and also cross a line perpendicular to the direction of rolling of said material;

arranging said work rolls and said back-up rolls such that a first thrust force acts from each back-up roll to an associated work roll in a direction opposite to a direction in which a second thrust force acts from said material to the work roll so that an actual thrust force acting on the work roll is equal to a difference between said first and second thrust forces; and providing a lubricant supply device for supplying an axial thrust reducing lubricant to a zone between each work roll having its axis crossing the axis of an associated back-up roll and the back-up roll with which said work roll is in direct contact, to thereby maintain axial thrust reducing lubrication in said zone, whereby the actual thrust force is reduced by the lubrication in said zone between the work roll and the back-up roll, whereby said rolling mill is revamped into a type in which the work rolls can be inclined and be operated without excessive axial thrust forces on said work rolls.

7. A method of controlling a rolling mill of the type that has a pair of work rolls and a pair of back-up rolls for respectively supporting the work rolls being provided on a rolling stand, said work rolls being arranged such that their axes can be inclined in a horizontal plane such that a rolling of a material to be rolled is carried out with the axes of said work rolls crossing each other, said back-up rolls being arranged such that the axes of said back-up rolls are disposed in a horizontal plane and fixed in a direction substantially perpendicular to a direction of rolling of said material, said work rolls being supported such that respective angles of inclination of respective work rolls are controllable so that the axes of said work rolls cross the axes of said back-up rolls and also cross a line perpendicular to the direction of rolling of said material, said work rolls and said back-up rolls being arranged such that a first thrust force acts from each back-up roll to an associated work roll in a direction opposite to a direction in which a second thrust force acts from said material to the work roll so that an actual thrust force acting on the work roll is equal to a difference between said first and second thrust forces, and a lubricant supply device is provided for supplying an axial thrust reducing lubricant to a zone between each work roll having its axis crossing the axis of an associated back-up roll and the back-up roll with which said work roll is in direct contact, to thereby maintain axial thrust reducing lubrication in said zone, whereby the actual thrust force is reduced by the lubrication in said zone between the work roll and the back-up roll, said method comprising the steps of:

controlling the respective angles of inclination of said work rolls in accordance with a rolling condition in a rolling of a material such that the respective angles of inclination of said work rolls are changed during the rolling operation; and controlling the supply of said lubricant in accordance with the rolling condition.

8. A rolling mill in which a pair of work rolls and a pair of back-up rolls for respectively supporting the work rolls are provided as work roll and back-up roll combinations on a rolling stand, wherein axes of the back-up rolls are not inclined in a horizontal plane while axes of the work rolls are configured and supported to be inclined in a horizontal plane relative to the back-up rolls such that the axes of the work rolls cross the axes of the back-up rolls and such that the axes of the work rolls cross each other, said work rolls and said back-up rolls being arranged such that a first thrust force acts from each back-up roll to an associated work roll in a direction opposite to a direction in which a second thrust force acts from said material to the work roll so that an actual thrust force acting on the work roll is equal to a difference between said first and second thrust forces, a lubricant supply device being provided for supplying an axial thrust reducing lubricant to a zone between each work roll having its axis crossing the axis of an associated back-up roll and the back-up roll with which said work roll is in direct contact, to thereby maintain axial thrust reducing lubrication in said zone, whereby the actual thrust force is reduced by the lubrication in said zone between the work roll and the back-up roll.

9. A rolling mill comprising:

a pair of work rolls;

a pair of back-up rolls for supporting the work rolls, with said back-up rolls being provided as work roll and back-up roll combinations on a rolling stand, axes of the back-up rolls not being inclined in a horizontal plane and axes of the work rolls being configured and supported to be inclined in a horizontal plane relative to the back up rolls such that the axes of the work rolls cross the axes of the back-up rolls and such that the axes of the work rolls cross each other;

a lubricant supply device for supplying a lubricant between the work roll and back-up roll of each combination; and a controller configured to vary the amount and type of supplied lubricant as a function of a respective angle between an axis of a work roll and a line perpendicular to a direction of rolling.

10. A rolling mill according to claim 9, comprising devices for moving the work rolls in an axial direction thereof.

11. A rolling mill according to claim 9, wherein a member is provided near each work roll for preventing a cooling water for the work roll from entering a region of the rolls between the work roll and associated back-up roll.

12. A rolling method using a rolling mill including a pair of work rolls and a pair of back-up rolls for respectively supporting the work rolls, arranged in respective roll and back-up roll combinations, comprising:

adjusting a crown of material being rolled during rolling by controlling an inclination of axes of the work rolls relative to the back-up rolls in a horizontal plane such that the axes of the work rolls cross axes of the back-up rolls and such that the axes of the work rolls cross each other, and supplying a lubricant between the work roll and back-up roll of each combination during rolling, wherein the amount and type of lubricant supplied is varied according to a respective angle between the axis of a work roll and a line perpendicular to a direction of rolling.

13. A rolling method according to claim 12, further comprising controlling a movement of work rolls in an axial direction thereof.

14. A rolling method according to claim 12, further comprising changing a cross angle of each work roll during rolling.

15. A rolling method according to claim 12, comprising suspension of the supply of the lubricant when the material being rolled leaves the work rolls.

16. A rolling mill comprising:

a pair of work rolls which each have a rotational work roll axis, a pair of back-up rolls for respectively supporting the work rolls, said back-up rolls each having a rotational back-up roll axis, said work rolls being supported during rolling operations with their respective rotational work roll axes crossed with respect to one another and crossed with respect to respective associated back-up roll axes, said work rolls and said back-up rolls being arranged such that a first thrust force acts from each back-up roll to an associated work roll in a direction opposite to a direction in which a second thrust force acts from said material to the work roll so that an actual thrust force acting on the work roll is equal to a difference between said first and second thrust forces; and a lubricant supply device is provided for supplying an axial thrust reducing lubricant to a zone between each work roll having its axis crossing the axis of an associated back-up roll and the back-up roll with which said work roll is in direct contact, to thereby maintain axial thrust reducing lubrication in said zone, whereby the actual thrust force is reduced by the lubrication in said zone between the work roll and the back-up roll.

17. A rolling mill according to claim 16, wherein said resultant value is not substantially greater than resultant axial thrust forces acting on work rolls of a substantially similar rolling mill operated without crossing of the work rolls and with a substantially similar level of rolling pressure on the material being rolled.

18. A rolling mill according to claim 16, wherein said predetermined percentage is 5%.

19. A rolling mill according to claim 17, wherein said pair of back-up rolls are supported with their back-up roll axes extending parallel to one another and perpendicular to a travel direction of material being rolled between the work rolls during normal rolling operations.

20. A rolling mill according to claim 17, comprising a work roll control device for changing a cross-angle of said work roll axes during rolling operations.

21. A rolling mill according to claim 19, comprising a work roll control device for changing a cross-angle of said work roll axes during rolling operations.

22. A rolling mill according to claim 16, comprising a lubricant supplier controller for controlling supply of lubricant by said lubricant supplier in dependence on rolling conditions of said rolling mill.

23. A rolling mill according to claim 17, comprising a lubricant supplier controller for controlling supply of lubricant by said lubricant supplier in dependence on rolling conditions of said rolling mill.

24. A method of rolling a strip of material in a rolling mill of the type comprising:

a pair of work rolls which each have a rotational work roll axis, a pair of back-up rolls for respectively supporting the work rolls, said back-up rolls each having a rotational back-up roll axis, said work rolls being supported during rolling operations with their respective rotational work roll axes crossed with respect to one another and crossed with respect to respective associated back-up roll axes, said work rolls and said back-up rolls being arranged such that a first thrust force acts from each back-up roll to an associated work roll in a direction opposite to a direction in which a second thrust force acts from said material to the work roll so that an actual thrust force acting on the work roll is equal to a difference between said first and second thrust forces; and a lubricant supply device being provided for supplying an axial thrust reducing lubricant to a zone between each work roll having its axis crossing the axis of an associated back-up roll and the back-up roll with which said work roll is in direct contact, to thereby maintain axial thrust reducing lubrication in said zone, whereby the actual thrust force is reduced by the lubrication in said zone between the work roll and the back-up roll said method comprising:

operating said rolling mill by pressing said work rolls against said strip of material with a rolling pressure, and supplying axial thrust reducing lubricant between said respective back-up rolls and work rolls to thereby assure maintenance of said resultant axial thrust forces acting on the work rolls at a value less than a predetermined percentage of the rolling pressure exerted on the material being rolled during rolling operations.

25. A method according to claim 23, wherein said resultant value is not substantially greater than resultant axial thrust forces acting on work rolls of a substantially similar rolling mill operated without crossing of the work rolls and with a substantially similar level of rolling pressure on the material being rolled.

26. A rolling method of rolling according to claim 24, wherein said predetermined percentage is 5%.

27. A rolling method according to claim 25, comprising controllably changing cross-angles of said work roll axes during rolling operations.

28. A rolling method according to claim 25, comprising controlling said supplying of lubricant in dependence on rolling conditions of said rolling mill.

29. A rolling method according to claim 27, comprising controlling said supplying of lubricant in dependence on rolling conditions of said rolling mill.

30. A rolling method according to claim 28, wherein said rolling conditions include approaching of an end of said strip material.

31. A rolling method according to claim 28, wherein said rolling conditions include approaching of an end of said strip material.

32. A rolling method according to claim 28, wherein said rolling conditions include a respective cross-angle of said work roll axes.

33. A rolling mill stand comprising:

a pair of work rolls;

a pair of back-up rolls for supporting the work rolls, axes of the back-up rolls not being adjustably inclined in a horizontal plane and axes of the work rolls being configured and supported to be adjustably inclined in a horizontal plane relative to the back-up rolls such that the axes of the work rolls cross the axes of the back-up rolls and such that the axes of the work rolls cross each other, said work rolls and said back-up rolls being arranged such that a first thrust force acts from each back-up roll to an associated work roll in a direction opposite to a direction in which a second thrust force acts from said material to the work roll so that an actual thrust force acting on the work roll is equal to a difference between said first and second thrust forces; and a lubricant supply device is provided for supplying an axial thrust reducing lubricant to a zone between each work roll having its axis crossing the axis of an associated back-up roll and the back-up roll with which said work roll is in direct contact, to thereby maintain axial thrust reducing lubrication in said zone, whereby the actual thrust force is reduced by the lubrication in said zone between the work roll and the back-up roll.

34. A rolling mill in which a pair of work rolls and a pair of back-up rolls for respectively supporting the work rolls are provided on a rolling stand and said work rolls are arranged such that their axes can be adjustably inclined in a horizontal plane such that a rolling of a material to be rolled is carried out with the axes of said work rolls crossing each other;

wherein said work rolls are supported such that respective angles of inclination of respective work rolls are controllable so that the axes of said work rolls cross the axes of said back-up rolls and also cross a line perpendicular to the direction of rolling of said material;

wherein said work rolls and said back-up rolls are arranged such that a first thrust force acts from each back-up roll to an associated work roll in a direction opposite to the direction in which a second thrust force acts from said material to the work roll so that an actual thrust force acting on the work roll is equal to a difference between said first and second thrust forces; and a lubricant supply device is provided for supplying an axial thrust reducing lubricant to a zone between each work roll having its axis crossing the axis of an associated back-up roll and the back-up roll with which said work roll is in direct contact, to thereby maintain axial thrust reducing lubrication in said zone, whereby the actual thrust force is reduced by the lubrication in said zone between the work roll and the back-up roll.

35. A method of making rolled strip material comprising:

providing strip material, rolling said strip material in a rolling mill stand having a pair of work rolls and back-up rolls supporting the work rolls, said rolling includes adjustably inclining axes of the work rolls with respect to one another and with respect to axes of said back-up rolls to thereby control crown of the strip material being rolled, wherein said work rolls and said back-up rolls are arranged such that a first thrust force acts from each back-up roll to an associated work roll in a direction opposite to the direction in which a second thrust force acts from said material to the work roll so that an actual thrust force acting on the work roll is equal to a difference between said first and second thrust forces, and supplying an axial thrust reducing lubricant to a zone between each work roll having its axis crossing the axis of an associated back-up roll and the back-up roll with which said work roll is in direct contact, to thereby maintain axial thrust reducing lubrication in said zone, whereby the actual thrust force is reduced by the lubrication in said zone between the work roll and the back-up roll.

36. A rolling mill according to claim 4, wherein said controller is operable to control said cross-angle controlling system to reduce said cross-angle substantially to zero when at least one of said allowable maximum magnitudes are exceeded.

37. A hot mill according to claim 3, wherein said lubricant supply device is configured to reduce the actual thrust force ac;ting on said work rolls to a value not greater than 5% of a maximum rolling load acting on material being rolled during rolling operation of said mill.

38. A hot rolling system according to claim 5, wherein said lubricant supply device is configured to reduce the actual thrust force acting on said work rolls to a value not greater than 5% of a maximum rolling load acting on material being rolled during rolling operation of said mill.

39. A method according to claim 6, wherein said lubricant supply device is configured to reduce the actual thrust force acting on said work rolls to a value not greater than 5% of a maximum rolling load acting on material being rolled during rolling operation of said mill.

40. A method according to claim 35, wherein said supplying an actual thrust force reducing lubricant to said work rolls and back-up rolls includes supplying sufficient thrust force reducing lubricant to reduce the actual thrust force to a level less than one-half of the value of said axial thrust forces between said work rolls and back-up rolls without said thrust force reducing lubricant.

41. A method according to claim 35, comprising providing a further lubricant to said work rolls with a different composition than said thrust force reducing lubricant.

42. A method according to claim 40, wherein said lubricant supply device is configured to reduce the actual thrust force acting on said work rolls to a value not greater than 5% of a maximum rolling load acting on material being rolled during rolling operation of said mill.

43. A method according to claim 35, wherein said rolling is hot rolling of a hot material strip.

44. A method according to claim 40, wherein said rolling is hot rolling of a hot material strip.

45. A method according to claim 42, wherein said rolling is hot rolling of a hot material strip.

46. A rolling mill stand comprising:

a first work roll rotatable about a first work roll axis, a second work roll rotatable about a second work roll axis, said first and second work rolls being engageable with respective opposite sides of a material strip to roll said material strip during rolling operations with said material strip traveling between the work rolls, a first back-up roll rotatable about a first back-up roll axis and supportingly engageable with said first work roll at a side of said second work roll opposite the material strip being rolled, a second back-up roll rotatable about a second back-up roll axis and supportingly engageable with said second work roll at a side of said second work roll opposite the material strip being rolled, said first and second work rolls being supported to be adjustably inclined with respect to one another and to the first and second back-up rolls during rolling operations such that radial planes through the respective first and second work roll axes cross each other and cross respective radial planes through the respective first and second back-up roll axes, whereby each of said work rolls experiences an actual axial thrust force equal to a difference between axial thrust forces in one axial direction from the material strip being rolled and in an opposite axial direction from a respective associated back-up roll, an axial thrust force reducing lubricant supplied to a zone between each work roll having its axis crossing the axis of an associated back-up roll and the back-up roll with which said work roll is in direct contact, to thereby maintain axial thrust reducing lubrication in said zone, whereby the actual thrust force is reduced by the lubrication in said zone between the work roll and the back-up roll, and a further lubricant having a different composition than the axial thrust reducing lubricant between the work rolls and the material strip being rolled, whereby the axial thrust force reducing lubricant reduces the actual axial thrust forces on said work rolls facilitating rolling operations with said adjustably inclined work rolls.

47. A rolling mill stand according to claim 46, wherein said rolling mill stand is a hot rolling mill stand, and wherein said further lubricant has a composition for maintaining a high viscosity at high temperatures to lubricate between the work roll and hot material strip being rolled.

48. A rolling mill stand according to claim 46, wherein said thrust force reducing lubricant is a mineral oil based lubricant.

49. A rolling mill stand according to claim 47, wherein said thrust force reducing lubricant is a mineral oil based lubricant.

* * * * *